US011719023B2

(12) United States Patent
Oda et al.

(10) Patent No.: US 11,719,023 B2
(45) Date of Patent: Aug. 8, 2023

(54) VEHICULAR DOOR LOCK DEVICE AND VEHICULAR DOOR LOCK SYSTEM

(71) Applicant: AISIN CORPORATION, Aichi (JP)

(72) Inventors: Toshitsugu Oda, Kariya (JP); Shinsuke Takayanagi, Kariya (JP); Masayuki Uchitsunemi, Anjo (JP)

(73) Assignee: AISIN CORPORATION, Kariya (JP)

( * ) Notice: Subject to any disclaimer, the term of this patent is extended or adjusted under 35 U.S.C. 154(b) by 232 days.

(21) Appl. No.: 17/115,043

(22) Filed: Dec. 8, 2020

(65) Prior Publication Data

US 2021/0180370 A1 Jun. 17, 2021

(30) Foreign Application Priority Data

Dec. 16, 2019 (JP) ..... 2019-226257

(51) Int. Cl.
*E05B 81/16* (2014.01)
*E05B 81/32* (2014.01)
(Continued)

(52) U.S. Cl.
CPC ..... *E05B 81/16* (2013.01); *E05B 81/04* (2013.01); *E05B 81/18* (2013.01); *E05B 81/32* (2013.01)

(58) Field of Classification Search
CPC ..... E05B 81/04; E05B 81/06; E05B 81/14; E05B 81/18; E05B 81/20; E05B 81/30; E05B 81/32; E05B 81/34; E05B 81/36; E05B 83/04; E05B 83/40; E05B 85/10; E05B 85/24; E05B 85/245; E05B 85/26; Y10T 292/081; Y10T 292/0825; Y10T 292/0826; Y10T 292/0829; Y10T 292/0848; Y10T 292/0849; Y10T 292/0852; Y10T 292/0854;
(Continued)

(56) References Cited

U.S. PATENT DOCUMENTS 2,224,671 A * 12/1940 Crooks ..... E05B 47/0002 292/25
5,192,096 A * 3/1993 Weinerman ..... E05C 3/34 70/130
(Continued)

FOREIGN PATENT DOCUMENTS

GB 2446145 A * 8/2008 ..... E05B 15/021
JP 2005-88812 A 4/2005
KR 100858192 B1 * 9/2008 ..... E05B 79/02

*Primary Examiner* — Christine M Mills
*Assistant Examiner* — Christopher F Callahan
(74) *Attorney, Agent, or Firm* — Oblon, McClelland, Maier & Neustadt, L.L.P.

(57) ABSTRACT

A lower lock device includes a base being fixed to a slide door, a first hook and a second hook each including a base end portion being rotatably supported by the base, and a driving link that is rotatably supported by the base, and drives the first hook and the second hook. The first hook and the second hook rotate between an engaged position of sandwiching a lower striker by tip portions being close to each other and a retracted position in which the tip portions are separated from each other. The driving link is displaced between a first position in which the first hook and the second hook are disposed in the engaged position and a second position in which the first hook and the second hook are disposed in the retracted position.

6 Claims, 19 Drawing Sheets

(51) Int. Cl.
*E05B 81/04* (2014.01)
*E05B 81/18* (2014.01)

(58) Field of Classification Search
CPC ..... Y10T 292/0856; Y10T 292/0862; Y10T 292/1082; Y10S 292/23; Y10S 292/46
See application file for complete search history.

(56) References Cited

U.S. PATENT DOCUMENTS

| | | | | |
|---|---|---|---|---|
| 6,729,661 | B2 * | 5/2004 | Perez-Sanchez | B64C 1/1476 292/25 |
| 2004/0178643 | A1 * | 9/2004 | Marzolf | E05B 85/247 292/201 |

* cited by examiner

VEHICULAR DOOR LOCK DEVICE AND VEHICULAR DOOR LOCK SYSTEM

CROSS REFERENCE TO RELATED APPLICATIONS

This application is based on and claims priority under 35 U.S.C. § 119 to Japanese Patent Application 2019-226257, filed on Dec. 16, 2019, the entire content of which is incorporated herein by reference.

TECHNICAL FIELD

This disclosure generally relates to a vehicular door lock device and a vehicular door lock system.

BACKGROUND DISCUSSION

JP2005-88812A (Reference 1) describes a vehicle including a vehicle body in which a door opening is formed on a side portion, and a front slide door and a rear slide door that open and close the door opening. The front slide door opens a front half of the door opening by sliding forward, and the rear slide door opens a rear half of the door opening by sliding rearward.

As described above, in a vehicle including double slide doors, a striker cannot be installed on a center pillar in a point that the center pillar is not present. In other words, in the vehicle as described above, a door lock device that restrains the slide door in a full closed position is needed even without a striker to be installed on the center pillar. Note that such a circumference is a circumference that is not limited to a vehicle including double slide doors and is also mostly common to a vehicle without a striker located in such a way as to face an end portion in a close direction of a door.

A need thus exists for a vehicular door lock device and a vehicular door lock system which are not susceptible to the drawback mentioned above.

SUMMARY

A vehicular door lock device that solves the problem described above is a vehicular door lock device that is provided on one of a door and a vehicle body, and restrains the door to the vehicle body by engaging with a striker provided on another of the door and the vehicle body. The vehicular door lock device includes a base being fixed to one of the door and the vehicle body, a first hook and a second hook each including a base end portion being rotatably supported by the base, and a driving body that is rotatably supported by the base and drives the first hook and the second hook. The first hook and the second hook rotate between an engaged position of sandwiching the striker by tip portions being close to each other and a retracted position in which the tip portions are separated from each other. The driving body is displaced between a first position in which the first hook and the second hook are disposed in the engaged position and a second position in which the first hook and the second hook are disposed in the retracted position.

A vehicular door lock system that solves the problem described above includes the vehicular door lock device described above, and the striker. The striker is provided on a lower end of a door opening to be opened and closed by the door in a state where a portion sandwiched between the first hook and the second hook extends in a vehicle front-rear direction. The vehicular door lock device is provided on the door in a state where a rotational shaft line of the first hook and a rotational shaft line of the second hook extend in the vehicle front-rear direction.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

First Embodiment

A first embodiment of a vehicle including a vehicular door lock system will be described below. In the following description, it is assumed that an axis extending in a vehicle width direction is an X axis, an axis extending in a vehicle front-rear direction is a Y axis, and an axis extending in a vehicle up-down direction is a Z axis.

Figure 1:
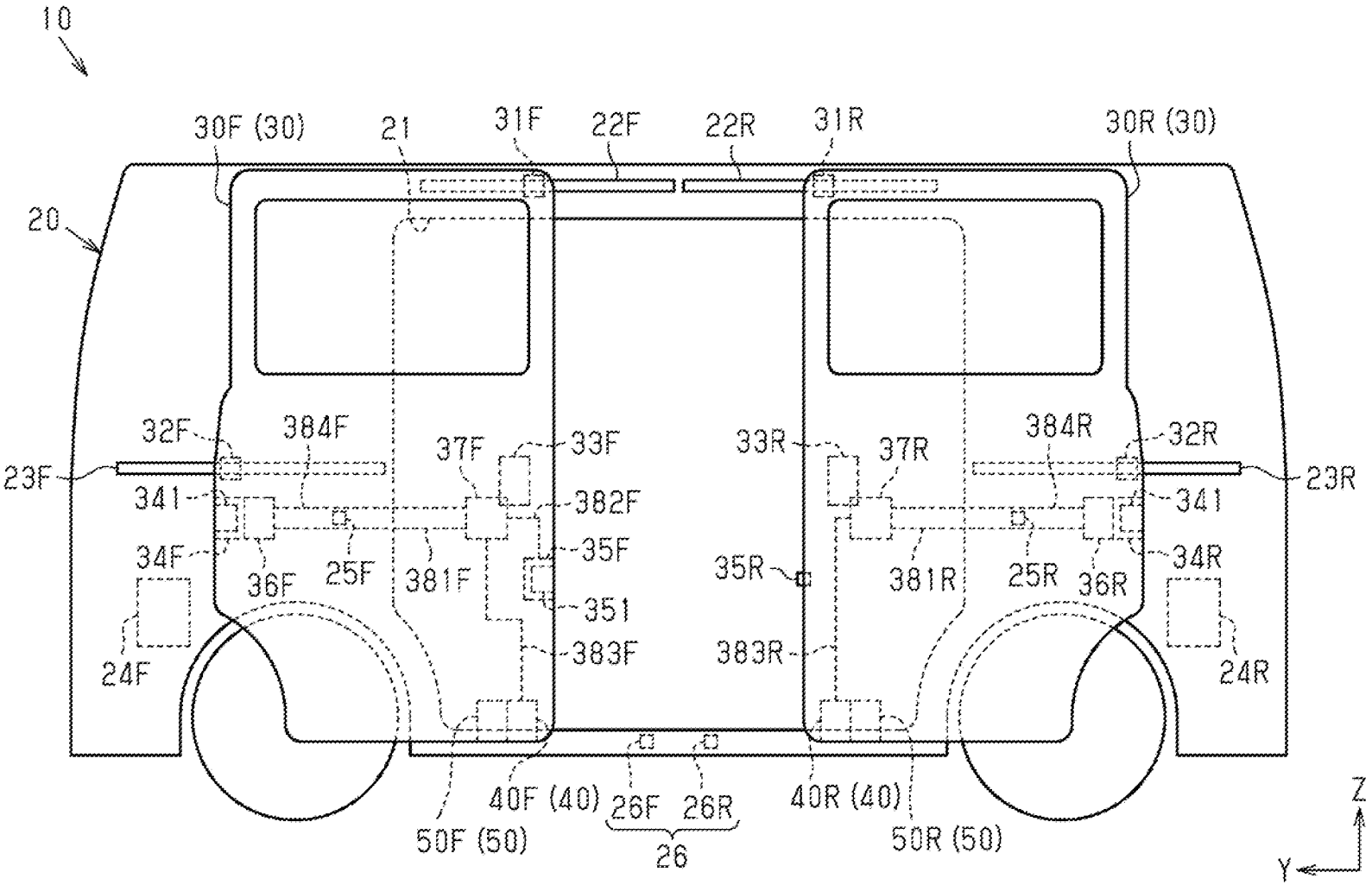
FIG. 1 is a side view illustrating a schematic configuration of a vehicle according to a first embodiment.

As illustrated in FIG. 1, the vehicle 10 includes a vehicle body 20 including a door opening 21, and a slide door 30 that opens and closes the door opening 21.

The vehicle body 20 includes upper rails 22F and 22R disposed above the door opening 21, center rails 23F and 23R disposed at the front and the rear of the door opening 21, respectively, and door driving units 24F and 24R that drive the slide door 30. Further, the vehicle body 20 includes a front striker 25F provided at the front of the door opening 21, a rear striker 25R provided at the rear of the door opening 21, and lower strikers 26F and 26R (26) provided on a lower end portion of the door opening 21 at the center in the front-rear direction of the door opening 21.

The upper rail 22F and the center rail 23F are disposed at the front with respect to the center in the front-rear direction of the door opening 21, and the upper rail 22R and the center rail 23R are disposed at the rear with respect to the center in the front-rear direction of the door opening 21. The upper rails 22F and 22R and the center rails 23F and 23R extend substantially in the front-rear direction.

The door driving units 24F and 24R are configured to include, for example, a motor and a transmission mechanism for transmitting power of the motor to the slide door 30. The transmission mechanism of the door driving units 24F and 24R can also be configured to include a pulley and a belt, and can also be configured to include a drum and a cable. Note that the door driving units 24F and 24R can be built in the slide door 30.

The slide door 30 includes a first slide door 30F that opens and closes a range from the center to a front end in the front-rear direction of the door opening 21, and a second slide door 30R that opens and closes a range from the center to a rear end in the front-rear direction of the door opening 21. It is assumed that a position when the slide door 30 fully opens the door opening 21 is a "full open position", and a position when the slide door 30 fully closes the door opening 21 is a "full closed position". It can be said that the slide door 30 according to the present embodiment is a so-called power slide door in a point that the door driving units 24F and 24R cause open/close operations between the full closed position and the full open position.

The first slide door 30F performs the open operation by moving to the front, and performs the close operation by moving to the rear. On the other hand, the second slide door 30R performs the open operation by moving to the rear, and performs the close operation by moving to the front. In other words, the first slide door 30F and the second slide door 30R perform the open operation by moving in a direction away from each other, and perform the close operation by moving in a direction close to each other.

The first slide door 30F includes an upper guide unit 31F and a center guide unit 32F that move along the upper rail 22F and the center rail 23F, respectively, and a door handle 33F disposed on a surface facing a compartment. Further, the first slide door 30F includes a front lock device 34F that restrains a front end portion of the first slide door 30F to the vehicle body 20, a center lock device 35F that couples a rear end portion of the first slide door 30F and a front end portion of the second slide door 30R, and a lower lock device 40F (40) that restrains a lower end portion of the first slide door 30F to the vehicle body 20.

Further, the first slide door 30F includes a front lock driving device 36F that drives the front lock device 34F, a lower lock driving device 50F (50) that drives the lower lock device 40F, the door handle 33F, a remote control 37F that relays power transmitted among the front lock driving device 36F, the center lock device 35F, and the lower lock device 40F. Furthermore, the first slide door 30F includes a first cable 381F that connects the front lock driving device 36F and the remote control 37F, a second cable 382F that connects the remote control 37F and the center lock device 35F, a third cable 383F that connects the remote control 37F and the lower lock device 40F, and a fourth cable 384F that connects the remote control 37F and the front lock driving device 36F.

The front lock device 34F includes a latch 341 that engages with the front striker 25F. The front lock device 34F switches between an engagement state where the latch 341 engages with the front striker 25F and a release state where the latch 341 does not engage with the front striker 25F.

The center lock device 35F includes a latch 351 that engages with a center striker 35R of the second slide door 30R, which will be described later. The center lock device 35F switches between an engagement state where the latch 351 engages with the center striker 35R and a release state where the latch 351 does not engage with the center striker 35R.

The lower lock device 40F switches between an engagement state where a first hook 421 and a second hook 422, which will be described later, engage with the lower striker 26F and a release state where the first hook 421 and the second hook 422 do not engage with the lower striker 26F.

Then, by being in the engagement state, the front lock device 34F, the center lock device 35F, and the lower lock device 40F restrain the first slide door 30F in the full closed position.

The front lock driving device 36F shifts the front lock device 34F from the release state to the engagement state, and shifts the front lock device 34F from the engagement state to the release state. After the first slide door 30F performs the close operation to the vicinity of the full closed position, the front lock driving device 36F shifts the front lock device 34F from the release state to the engagement state, and thus moves the first slide door 30F to the full closed position.

On the other hand, when the first slide door 30F performs the open operation from the full closed position, the front lock driving device 36F shifts the front lock device 34F from the engagement state to the release state, and thus releases a restraint of the first slide door 30F by the front lock device 34F. Further, when the front lock driving device 36F shifts the front lock device 34F from the engagement state to the release state, the front lock driving device 36F pulls the first cable 381F.

The lower lock driving device 50F shifts the lower lock device 40F from the release state to the engagement state. After the front lock driving device 36F shifts the front lock device 34F to the engagement state, that is, after the first slide door 30F is disposed in the full closed position, the lower lock driving device 50F shifts the lower lock device 40F to the engagement state. In this way, the lower lock driving device 50F restrains the lower end portion of the first slide door 30F to the vehicle body 20.

Note that a timing at which the lower lock driving device 50F shifts the lower lock device 40F to the engagement state can be the same timing as a timing at which the front lock driving device 36F shifts the front lock device 34F to the engagement state.

When the front lock driving device 36F shifts the front lock device 34F to the release state, that is, when the front lock driving device 36F pulls the first cable 381F, the remote control 37F pulls the second cable 382F and the third cable 383F. Then, the remote control 37F shifts the center lock device 35F and the lower lock device 40F from the engagement state to the release state.

Further, when a user performs an open operation on the door handle 33F, the remote control 37F pulls the second cable 382F, the third cable 383F, and the fourth cable 384F. Then, the remote control 37F shifts the front lock device 34F, the center lock device 35F, and the lower lock device 40F from the engagement state to the release state.

Next, the second slide door 30R will be described.

The second slide door 30R includes an upper guide unit 31R and a center guide unit 32R that move along the upper rail 22R and the center rail 23R, respectively, and a door handle 33R disposed on a surface facing the compartment. Further, the second slide door 30R includes a rear lock device 34R that restrains a rear end portion of the second slide door 30R to the vehicle body 20, the center striker 35R coupled to the rear end portion of the first slide door 30F, and a lower lock device 40R (40) that restrains a lower end portion of the second slide door 30R to the vehicle body 20.

Further, the second slide door 30R includes a rear lock driving device 36R that drives the rear lock device 34R, a lower lock driving device 50R (50) that drives the lower lock device 40R, the door handle 33R, and a remote control 37R that relays power transmitted between the rear lock driving device 36R and the lower lock device 40R. Furthermore, the second slide door 30R includes a first cable 381R that connects the rear lock driving device 36R and the remote control 37R, a third cable 383R that connects the remote control 37R and the lower lock device 40R, and a fourth cable 384R that connects the remote control 37R and the rear lock driving device 36R.

The second slide door 30R is configured substantially similarly to the first slide door 30F except for a point that the second slide door 30R includes the rear lock device 34R instead of the front lock device 34F, a point that the second slide door 30R includes the center striker 35R instead of the center lock device 35F, and a point that the second slide door 30R does not include a cable corresponding to the second cable 382F. Thus, description of the configuration in the second slide door 30R except for the center striker 35R will be omitted.

The center striker 35R is installed on the front end portion of the second slide door 30R and in a position facing the center lock device 35F of the first slide door 30F in the front-rear direction. The center striker 35R is a subject engaged with the latch 351 of the center lock device 35F.

Next, the lower lock device 40 and the lower lock driving device 50 will be described in detail. In the present embodiment, both of the lower lock devices 40F and 40R correspond to one example of a "vehicular door lock device". Further, the lower lock devices 40F and 40R have a symmetrical shape with respect to a surface orthogonal to the front-rear direction, and the lower lock driving devices 50F and 50R have a symmetrical shape with respect to the surface orthogonal to the front-rear direction. Thus, in the following description, the lower lock device 40F and the lower lock driving device 50F will be described by using the reference signs of the lower lock device 40 and the lower lock driving device 50.

Figure 2:
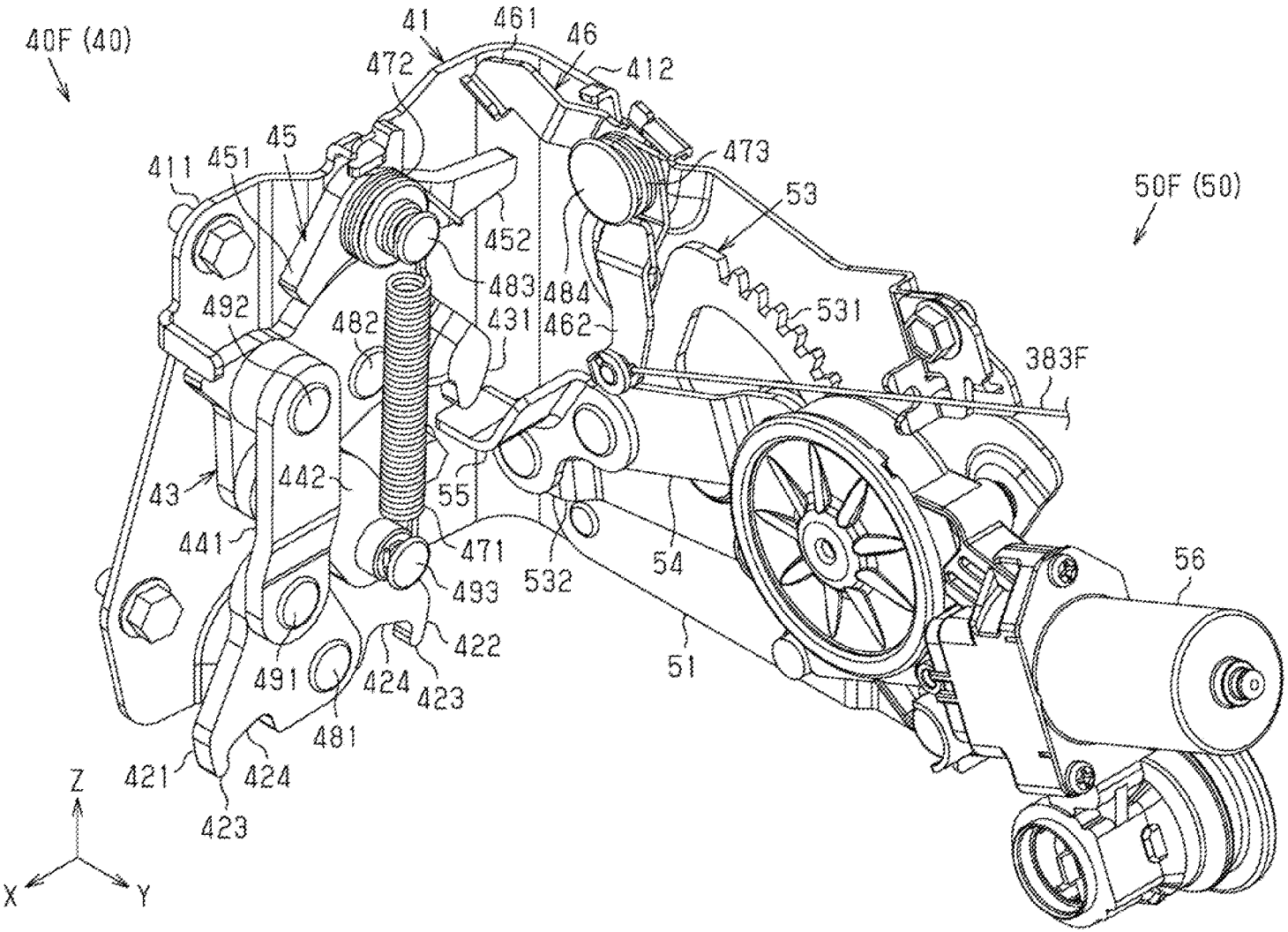
FIG. 2 is a perspective view of a lower lock device and a lower lock driving device according to the first embodiment.
Figure 3:
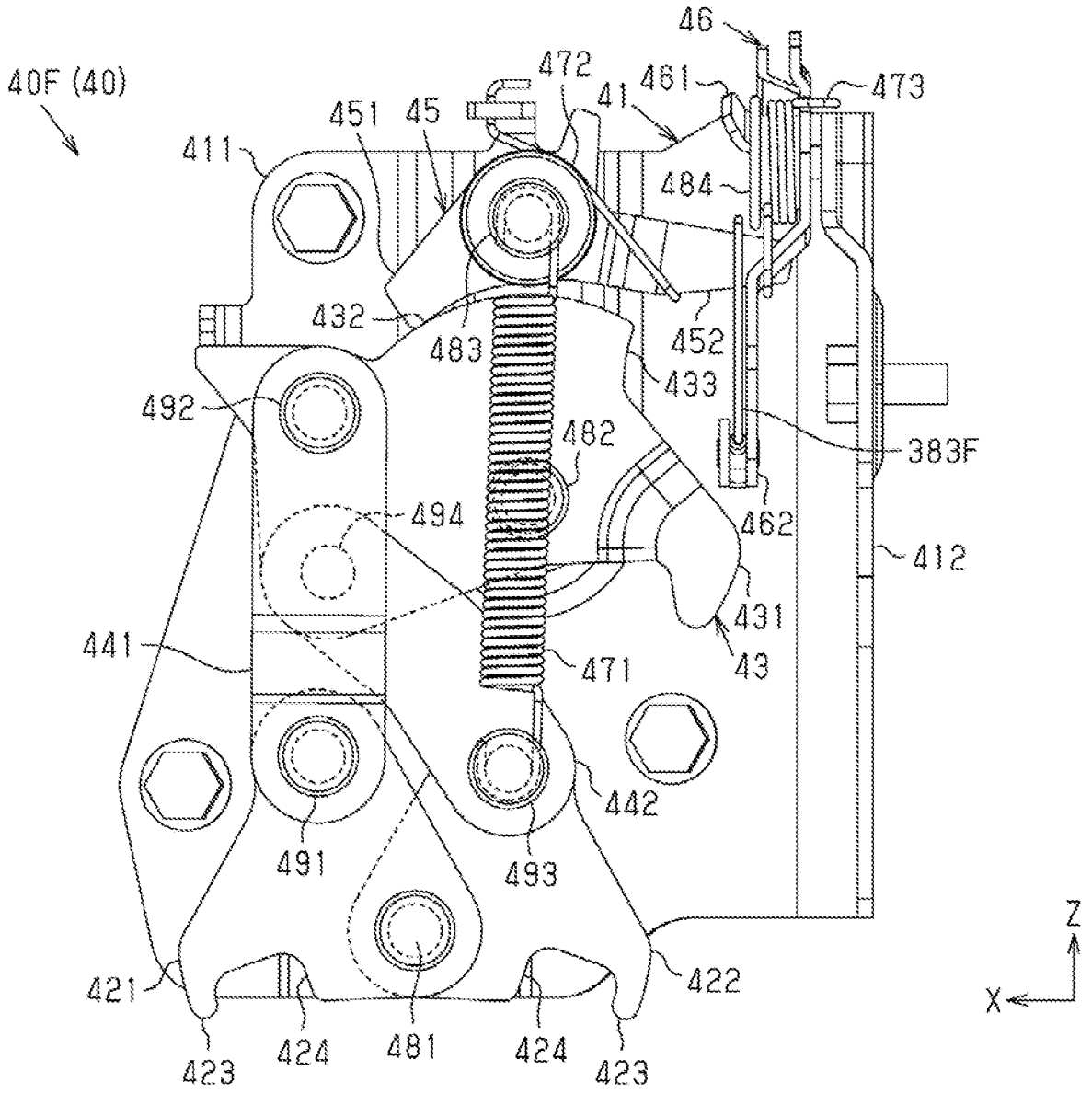
FIG. 3 is a front view of the lower lock device according to the first embodiment.

As illustrated in FIGS. 2 and 3, the lower lock device 40 includes a base 41 assembled to the slide door 30, the first hook 421 and the second hook 422 that engage with the lower striker 26, and a driving link 43 that drives the first hook 421 and the second hook 422. Further, the lower lock device 40 includes a first link 441 that couples the first hook 421 and the driving link 43, a second link 442 that couples the second hook 422 and the driving link 43, a pawl 45 that engages with the driving link 43, and a release lever 46 that drives the pawl 45. Further, the lower lock device 40 includes a hook biasing spring 471 that biases the second hook 422, a pawl biasing spring 472 that biases the pawl 45, and a release lever biasing spring 473 that biases the release lever 46.

Further, the lower lock device 40 includes a first support shaft 481 as one example of a "support shaft" that rotatably supports both of the first hook 421 and the second hook 422, a second support shaft 482 that rotatably supports the driving link 43, a third support shaft 483 that rotatably supports the pawl 45, and a fourth support shaft 484 that rotatably supports the release lever 46. Furthermore, the lower lock device 40 includes a first coupling shaft 491 that relatively rotatably couples the first hook 421 and the first link 441, a second coupling shaft 492 that relatively rotatably couples the driving link 43 and the first link 441, a third coupling shaft 493 that relatively rotatably couples the second hook 422 and the second link 442, and a fourth coupling shaft 494 that relatively rotatably couples the driving link 43 and the second link 442.

As illustrated in FIGS. 2 and 3, the base 41 includes a first base 411 and a second base 412 having a flat plate shape. The first base 411 extends in a direction intersecting the second base 412 from the second base 412. Thus, the base 41 has a substantially L shape in a plan view from above. The first base 411 is fixed to the slide door 30 via a fastening member such as a bolt. The second base 412 is coupled to the lower lock driving device 50 via a fastening member such as a bolt.

As illustrated in FIG. 3, the first hook 421 and the second hook 422 are a plate-shaped member having a substantially triangular shape in a front view. The first hook 421 and the second hook 422 are disposed on a lower end portion of the first base 411 by the first support shaft 481 having the front-rear direction as a shaft direction. In other words, a rotational shaft line of the first hook 421 and the second hook 422 extends in the front-rear direction.

In the first hook 421, when a portion supported by the first support shaft 481 and the first coupling shaft 491 is assumed to be a base end portion, the first hook 421 includes an engagement claw 423 and a recessed portion 424 on a tip portion. The engagement claw 423 extends in a rotational direction of the first hook 421, and the recessed portion 424 is recessed in an opposite direction to the direction in which the engagement claw 423 extends.

Similarly, in the second hook 422, when a portion supported by the first support shaft 481 and the third coupling shaft 493 is assumed to be a base end portion, the second hook 422 includes an engagement claw 423 and a recessed portion 424 on a tip portion. The engagement claw 423 extends in a rotational direction of the second hook 422, and the recessed portion 424 is recessed in an opposite direction to the direction in which the engagement claw 423 extends. A size of the recessed portion 424 of the first hook 421 and the second hook 422 is a size corresponding to the lower striker 26.

The first hook 421 and the second hook 422 rotate about a shaft line of the first support shaft 481 between an engaged position of sandwiching the lower striker 26 by bringing the tip portions closer to each other and a retracted position in which the tip portions are separated from each other. In the present embodiment, when the first hook 421 and the second hook 422 rotate between the engaged position and the retracted position, the first hook 421 and the second hook 422 have a positional relationship having substantial line symmetry with respect to a straight line passing through the center of the first support shaft 481 and extending in the up-down direction in FIG. 3. Further, when the first hook 421 and the second hook 422 are located in the engaged position, the lower striker 26 fits into the recessed portion 424 of the first hook 421 and the second hook 422.

As illustrated in FIGS. 2 and 3, the driving link 43 has a flat plate shape. The driving link 43 is disposed on a central portion of the first base 411 by the second support shaft 482 having the front-rear direction as a shaft direction. In other words, the driving link 43 is disposed at an interval from the first hook 421 and the second hook 422 in the up-down direction. As illustrated in FIG. 3, the driving link 43 includes an engagement protrusion 431 extending in a direction orthogonal to a rotational direction of the driving link 43, a slide surface 432 extending in the rotational direction of the driving link 43, and a regulation surface 433 extending in a direction that intersects the slide surface 432. The driving link 43 corresponds to one example of a "driving body".

As illustrated in FIG. 3, the first link 441 constitutes a four-joint link mechanism together with the driving link 43, the first base 411, and the first hook 421. In the four-joint link mechanism including the first link 441, a distance between shaft lines of the first support shaft 481 and the second support shaft 482 is longer than a distance between shaft lines of the first coupling shaft 491 and the second coupling shaft 492. Further, a distance between shaft lines of the first support shaft 481 and the first coupling shaft 491 and a distance between shaft lines of the second support shaft 482 and the second coupling shaft 492 are shorter than the distance between the shaft lines of the first coupling shaft 491 and the second coupling shaft 492. The first link 441 corresponds to a so-called intermediate link, and transmits power of the driving link 43 to the first hook 421.

On the other hand, the second link 442 constitutes a four-joint link mechanism together with the driving link 43, the first base 411, and the second hook 422. In the four-joint link mechanism including the second link 442, the distance between the shaft lines of the first support shaft 481 and the second support shaft 482 is longer than a distance between shaft lines of the third coupling shaft 493 and the fourth coupling shaft 494. Further, a distance between shaft lines of the first support shaft 481 and the third coupling shaft 493 and a distance between shaft lines of the second support shaft 482 and the fourth coupling shaft 494 are shorter than the distance between the shaft lines of the third coupling shaft 493 and the fourth coupling shaft 494. The second link 442 corresponds to a so-called intermediate link, and transmits power of the driving link 43 to the second hook 422.

The four-joint link mechanism including the first link 441 and the four-joint link mechanism including the second link 442 share the driving link 43. Thus, when the driving link 43 rotates, the first hook 421 and the second hook 422 rotate together. Further, when one of the first hook 421 and the second hook 422 rotates, the other of the first hook 421 and the second hook 422 rotates with the driving link 43. In other words, the first hook 421, the second hook 422, the driving link 43, the first link 441, and the second link 442 operate with each other. Therefore, when a position of the driving link 43 is determined, positions of the first hook 421 and the second hook 422 are also uniquely defined.

In the following description, it is assumed that a position of the driving link 43 when the first hook 421 and the second hook 422 are disposed in the engaged position is a "first position", and a position of the driving link 43 when the first hook 421 and the second hook 422 are disposed in the retracted position is a "second position". Further, the driving link 43 is displaced between the first position and the second position by rotating about the shaft line of the second support shaft 482.

As illustrated in FIGS. 2 and 3, the pawl 45 is disposed on an upper portion of the first base 411 by the third support shaft 483 having the front-rear direction as a shaft direction. In other words, the pawl 45 is disposed above the driving link 43. The pawl 45 includes a first engagement piece 451 and a second engagement piece 452 extending in a direction that intersects the shaft direction of the third support shaft 483. The first engagement piece 451 extends toward the driving link 43, and the second engagement piece 452 extends toward the second base 412.

As illustrated in FIG. 2, the release lever 46 is disposed on an upper portion of the second base 412 by the fourth support shaft 484 having the width direction as a shaft direction. The release lever 46 includes a first lever 461 and a second lever 462 extending in a direction that intersects the shaft direction of the fourth support shaft 484. The first lever 461 extends toward the first base 411, and the second lever 462 extends along the first base 411. An end portion of the third cable 383F extending from the remote control 37F is fixed to a tip of the second lever 462. When the third cable 383F is pulled, the release lever 46 rotates in a direction in which a tip of the first lever 461 is lowered.

As illustrated in FIGS. 2 and 3, the hook biasing spring 471 is a so-called extension coil spring. The hook biasing spring 471 has one end engaged with the third support shaft 483, and has another end engaged with the third coupling shaft 493. The hook biasing spring 471 biases the second hook 422 in a direction in which the second hook 422 rotates from the engaged position toward the retracted position.

As described above, when the second hook 422 rotates, the first hook 421 rotates, and thus it can also be said that the hook biasing spring 471 biases both of the first hook 421 and the second hook 422. Further, when the second hook 422 rotates, the driving link 43 rotates, and thus it can also be said that the hook biasing spring 471 biases the driving link 43 in a direction from the first position toward the second position. In this respect, the hook biasing spring 471 can replace the configuration in which the first hook 421 is biased, and can also replace the configuration in which the driving link 43 is biased.

As illustrated in FIGS. 2 and 3, the pawl biasing spring 472 is a so-called torsion coil spring. The pawl biasing spring 472 has one end engaged with the first base 411, and has another end engaged with the second engagement piece 452 of the pawl 45, while the third support shaft 483 is inserted. The pawl biasing spring 472 biases the pawl 45 in a direction in which the first engagement piece 451 pushes the driving link 43.

As illustrated in FIG. 2, the release lever biasing spring 473 is a so-called torsion coil spring. The release lever biasing spring 473 has one end engaged with a support plate 51 of the lower lock driving device 50, which will be described later, and has another end engaged with the second lever 462 of the release lever 46, while the fourth support shaft 484 is inserted. The release lever biasing spring 473 biases the release lever 46 in a direction in which the tip of the first lever 461 of the release lever 46 moves away from the second engagement piece 452 of the pawl 45.

Next, the lower lock driving device 50 will be described.

Figure 4:
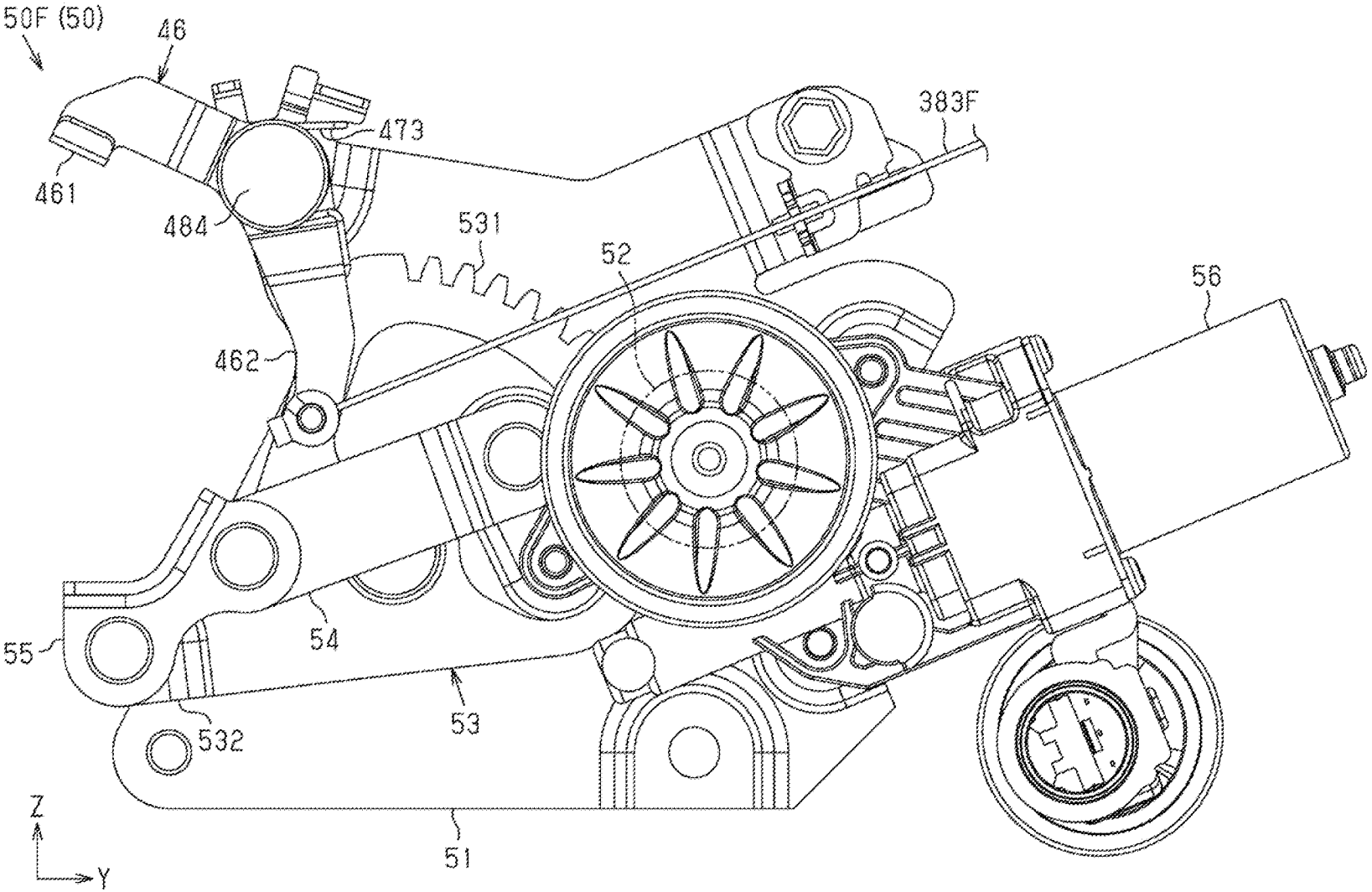
FIG. 4 is a side view of the lower lock driving device according to the first embodiment.

As illustrated in FIGS. 2 and 4, the lower lock driving device 50 includes the support plate 51 having a flat plate shape, a drive gear 52 rotatably supported by the support plate 51, an active lever 53 rotatably supported by the support plate 51, a coupling link 54 rotatably supported by the support plate 51, a close lever 55 that couples the active lever 53 and the coupling link 54, and a driving unit 56 that drives the drive gear 52.

The support plate 51 is coupled to the base 41 of the lower lock device 40 with a fastening member such as a bolt. The support plate 51 can also be integrally formed with the base 41 of the lower lock device 40. The active lever 53 includes a gear portion 531 that meshes with the drive gear 52, and a lever portion 532 coupled to the coupling link 54. The lever portion 532 extends toward the first base 411 of the lower lock device 40.

Then, the support plate 51, the active lever 53, the coupling link 54, and the close lever 55 constitute a four-joint link mechanism. Thus, when the active lever 53 rotates in one direction and another direction, the close lever 55 moves up and down. The driving unit 56 is configured to include a motor and a transmission mechanism for transmitting power of the motor to the drive gear 52. The driving unit 56 rotates the active lever 53 by rotating the drive gear 52. In this way, the lower lock driving device 50 operates the close lever 55 at any timing.

Next, a configuration according to the lower striker 26 will be described.

Figure 5:
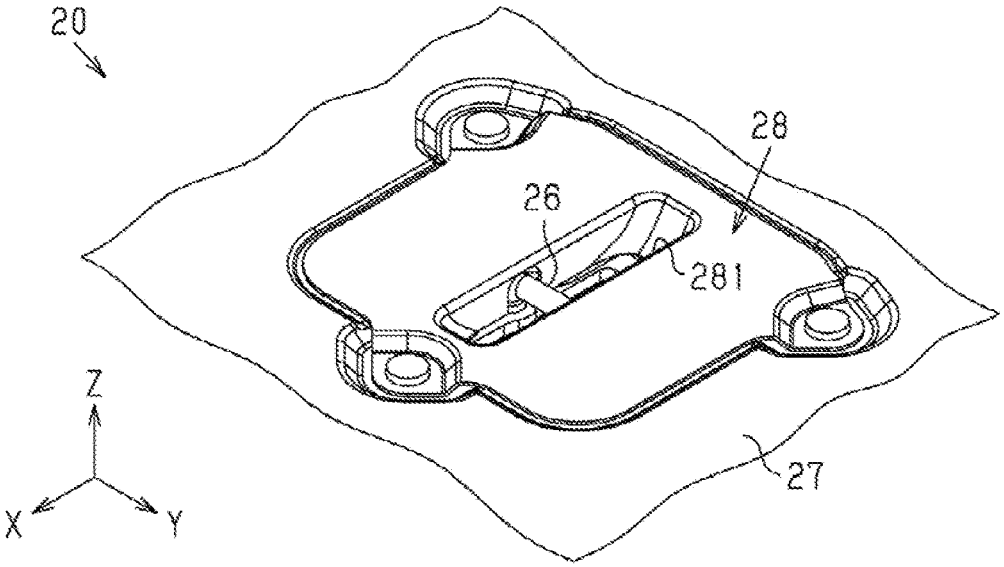
FIG. 5 is a perspective view of a floor of a vehicle body according to the first embodiment.
Figure 6:
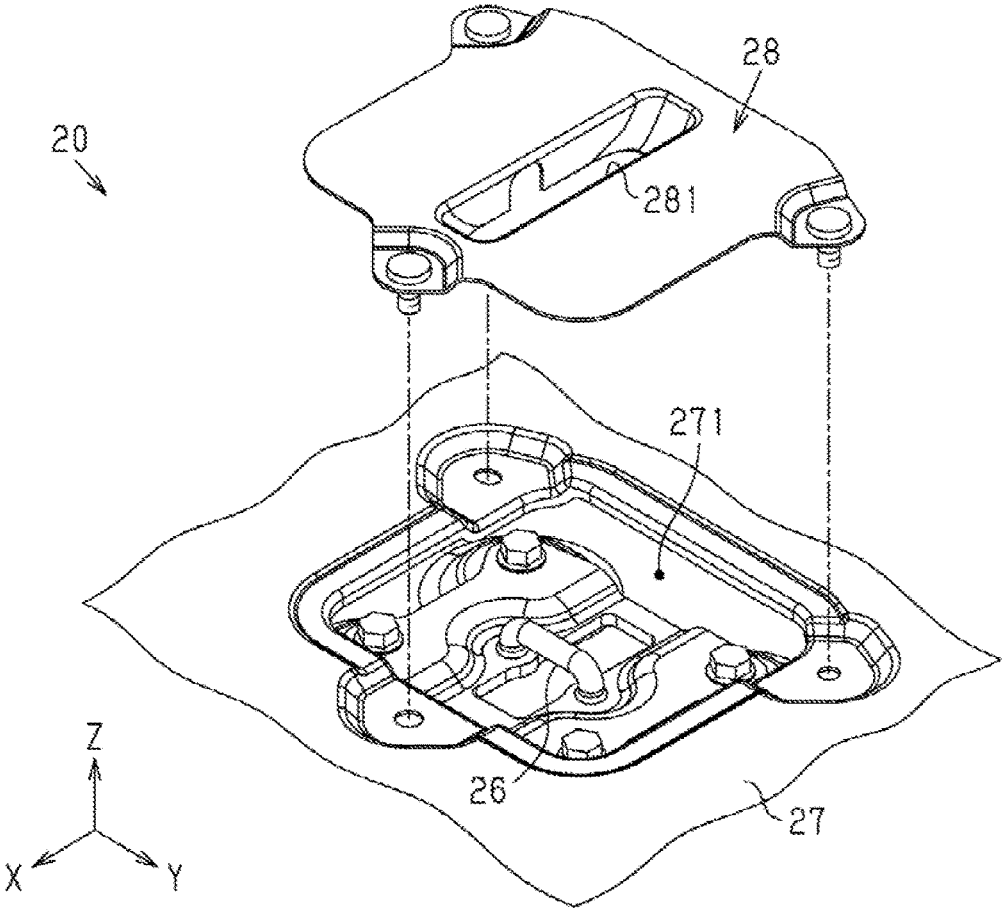
FIG. 6 is an exploded perspective view of the floor of the vehicle body according to the first embodiment.
Figure 7:
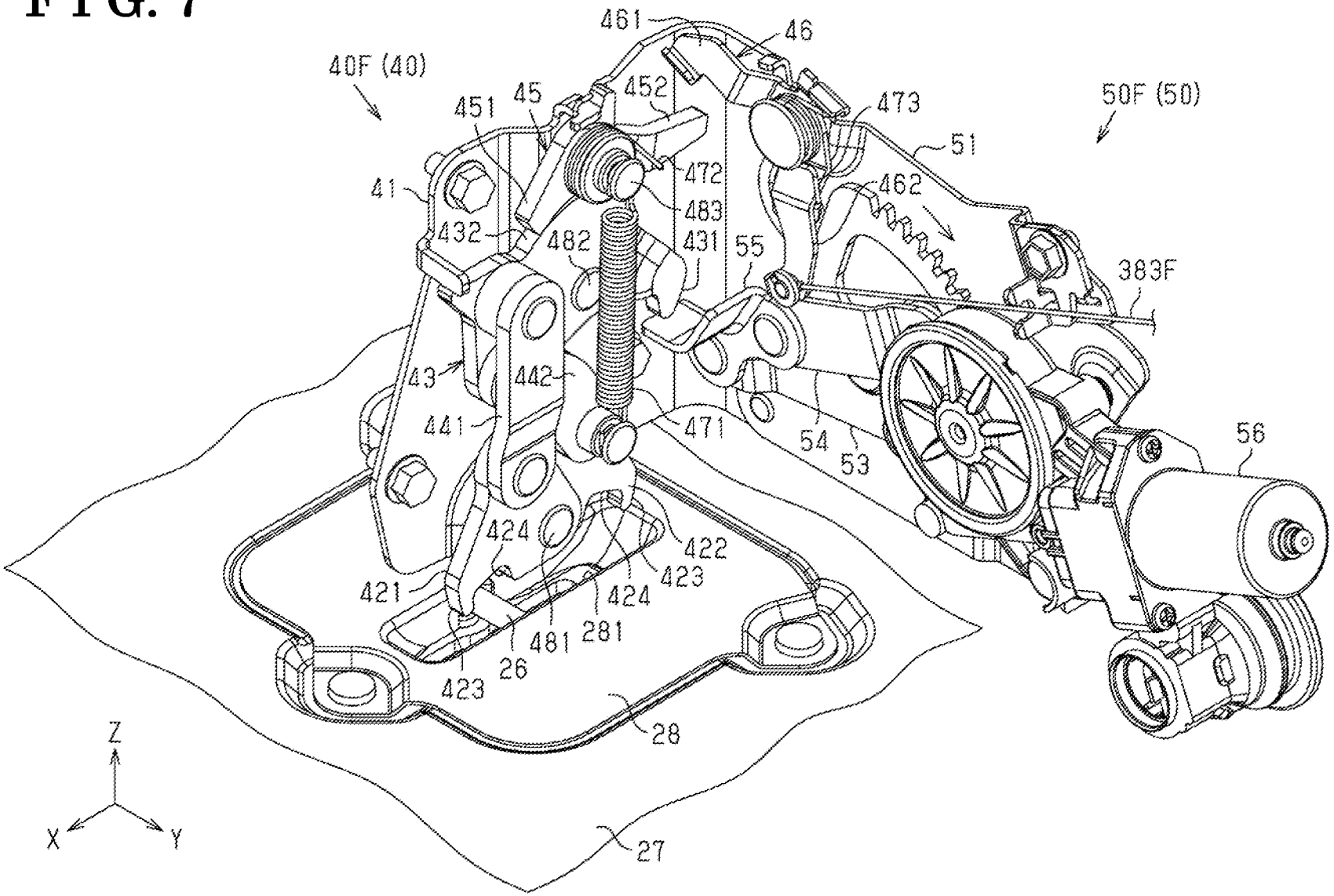
FIG. 7 is a perspective view of the lower lock device and a peripheral configuration when a first hook and a second hook are located in a retracted position in the first embodiment.

As illustrated in FIGS. 5 and 6, the vehicle body 20 includes a floor 27 in which the lower striker 26 described above is disposed, and a covering plate 28 that covers the lower striker 26.

The floor 27 includes a housing recessed portion 271 that houses the lower striker 26. The housing recessed portion 271 is provided in an outer end of the floor 27 in the width direction. In other words, the housing recessed portion 271 is provided in a lower end of the door opening 21. In the lower striker 26, a rod-like portion engaging with the first hook 421 and the second hook 422 of the lower lock device 40 extends in the front-rear direction. In other words, in the lower striker 26, the portion sandwiched between the first hook 421 and the second hook 422 extends in the front-rear direction.

The covering plate 28 includes a slit 281 having the width direction as a long-side direction and having the front-rear direction as a short-side direction. In other words, the slit 281 extends in a direction orthogonal to the direction in which the rod-like portion of the lower striker 26 extends, i.e., the width direction. The covering plate 28 is fixed to the floor 27 of the vehicle body 20 while covering the housing recessed portion 271. At this time, the covering plate 28 is preferably flush with the floor 27 of the vehicle body 20. Further, the covering plate 28 exposes the rod-like shape of the lower striker 26 to above from the slit 281.

In the present embodiment, one example of a "vehicular door lock system" including the lower lock device 40, the lower lock driving device 50, the lower striker 26, and the covering plate 28 described above is constituted.

Action of the present embodiment will be described.

Specifically, with reference to FIGS. 1 and 7 to 12, action of the lower lock device 40 and the lower lock driving device 50 during the close operation and the open operation of the slide door 30 will be described.

In the vehicle 10, when there is a request for the close operation of the slide door 30 from a user, the door driving units 24F and 24R are driven, and the close operation of the slide door 30 starts. When the slide door 30 performs the close operation to the vicinity of the full closed position, the front lock driving device 36F and the rear lock driving device 36R are driven instead of the door driving units 24F and 24R. As a result, the front lock device 34F and the rear lock device 34R shift to the engagement state, and the slide door 30 is disposed in the full closed position in which the slide door 30 fully closes the door opening 21.

When the slide door 30 is disposed in the full closed position, the rear end portion of the first slide door 30F and the front end portion of the second slide door 30R are located the closest to each other. Thus, the latch 351 of the center lock device 35F of the first slide door 30F engages with the center striker 35R of the second slide door 30R. In other words, when the slide door 30 is disposed in the full open position, the center lock device 35F also shifts to the engagement state. Power for shifting the center lock device 35F to the engagement state is a force of the center striker 35R pushing the latch 351 due to the close operation of the slide door 30.

At a stage at which the front lock device 34F, the rear lock device 34R, and the center lock device 35F shift to the engagement state, moment due to a dead weight acts on the slide door 30 and an elastic force of a weather strip compressed between the vehicle body 20 and the slide door 30 acts on the slide door 30, and thus an attitude of the lower end portion of the slide door 30 is not determined. Thus, the attitude of the lower end portion of the slide door 30 needs to be stable with the lower lock device 40 in the engagement state.

Thus, after the slide door 30 is disposed in the full closed position, the lower lock driving device 50 is driven. Specifically, the driving unit 56 is driven, and thus the active lever 53 rotates in a direction indicated by a solid line arrow in FIG. 7. Then, the close lever 55 rises in a direction indicated by a solid line arrow in FIG. 8, and the close lever 55 pushes the engagement protrusion 431 of the driving link 43 upward. As a result, the driving link 43 rotates in a first rotational direction R1 from the second position, and power is transmitted to the first hook 421 and the second hook 422 via the first link 441 and the second link 442. Further, when the driving link 43 rotates in the first rotational direction R1, the first engagement piece 451 of the pawl 45 slides on the slide surface 432 of the driving link 43.

Figure 9:
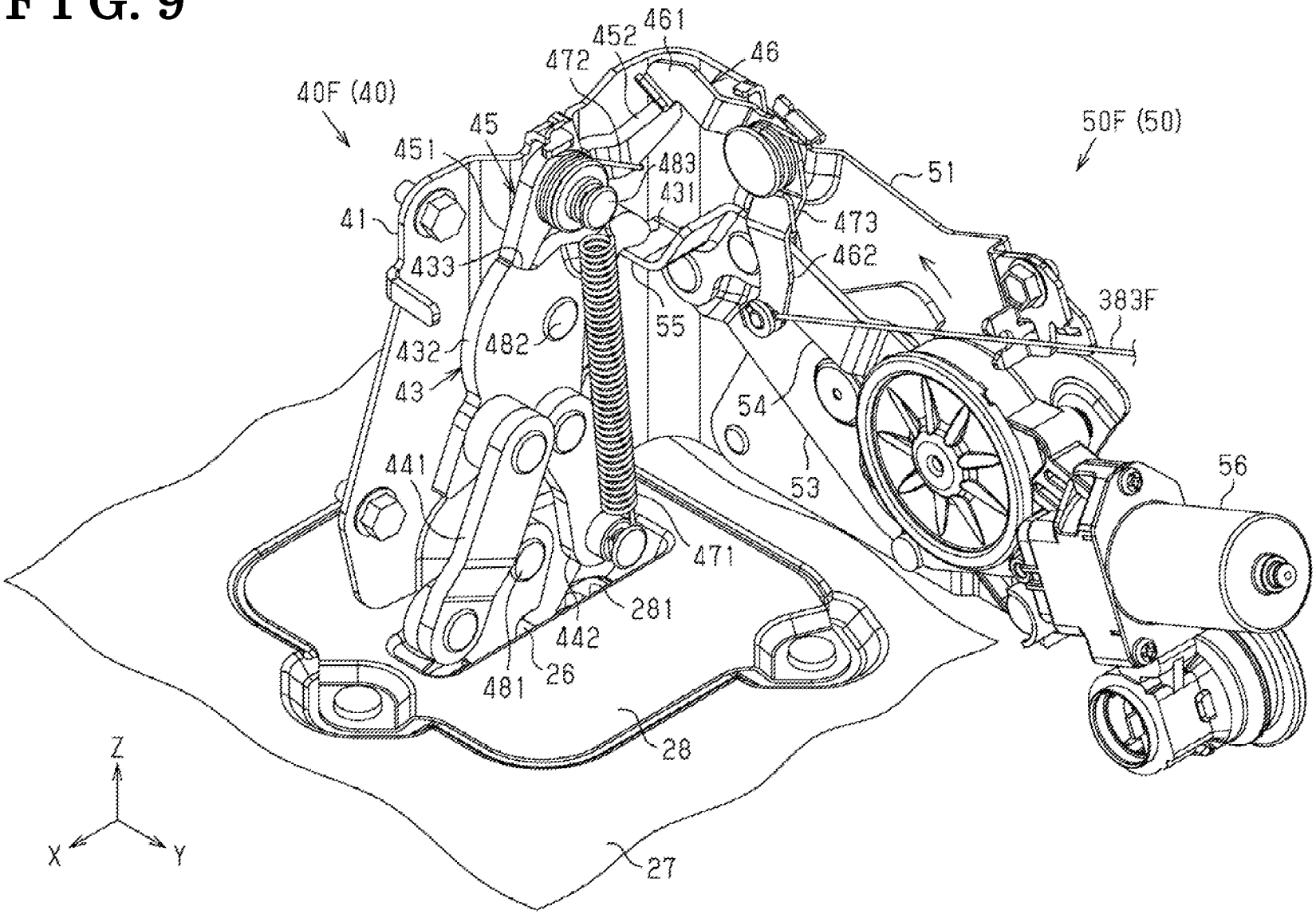
FIG. 9 is a perspective view of the lower lock device and the peripheral configuration when the first hook and the second hook are located in an engaged position in the first embodiment.
Figure 10:
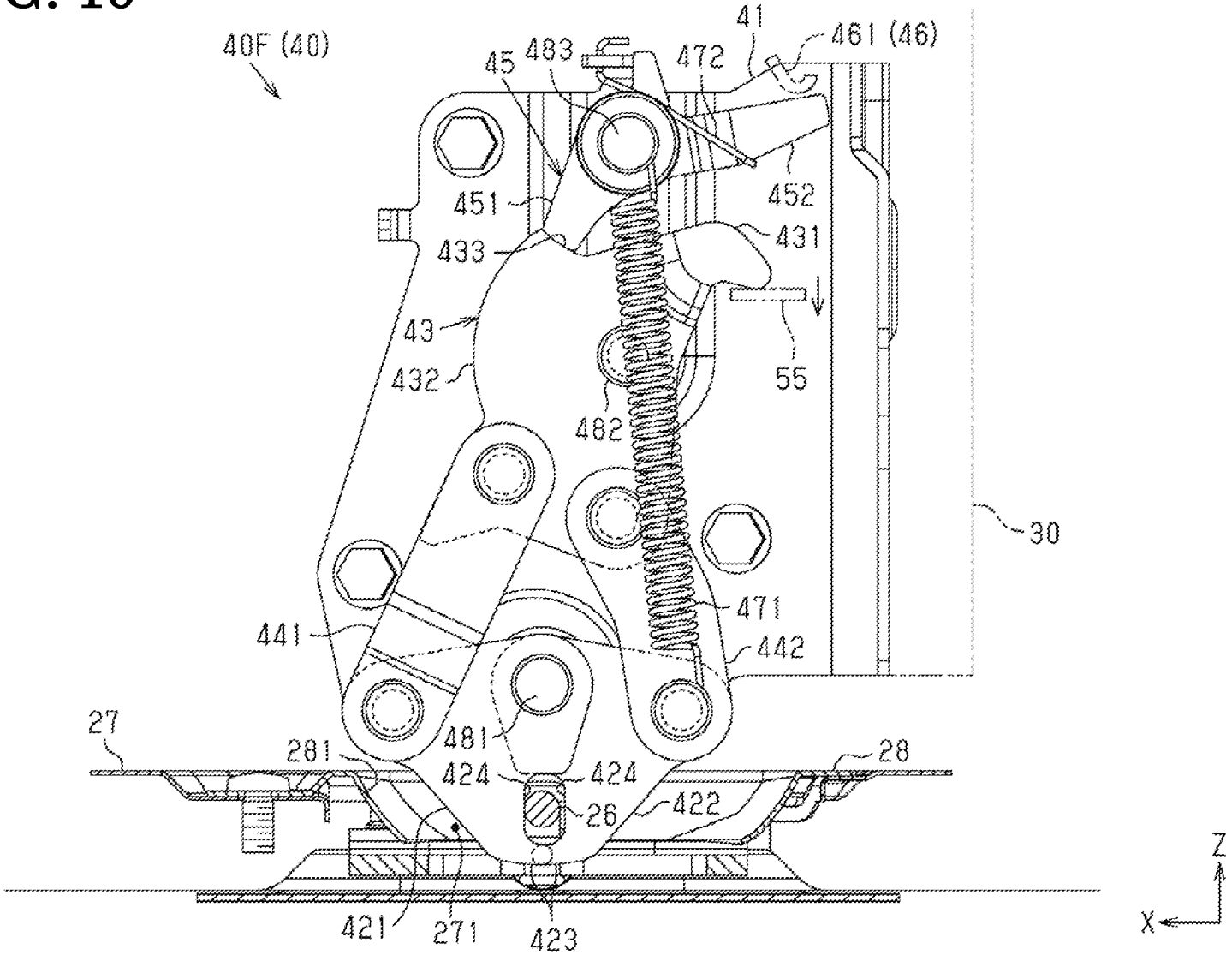
FIG. 10 is a front view of the lower lock device and the peripheral configuration when the first hook and the second hook are located in the engaged position in the first embodiment.

As illustrated in FIGS. 9 and 10, when the close lever 55 rises the highest, the driving link 43 is disposed in the first position. When the driving link 43 is disposed in the first position, the pawl 45 rotates based on a biasing force of the pawl biasing spring 472, and the first engagement piece 451 of the pawl 45 engages with the regulation surface 433 of the driving link 43. In other words, it is impossible for the driving link 43 to rotate toward the second position.

Further, when the driving link 43 is disposed in the first position, the first hook 421 and the second hook 422 rotate about the shaft line of the first support shaft 481 in directions different from each other, and thus are located in the engaged position of sandwiching the lower striker 26. In this way, a movement of the lower portion of the slide door 30 in the width direction is restricted, and the attitude of the slide door 30 in the full closed position is stable. Further, when the first hook 421 and the second hook 422 rotate to the engaged position, the hook biasing spring 471 is extended.

Figure 8:
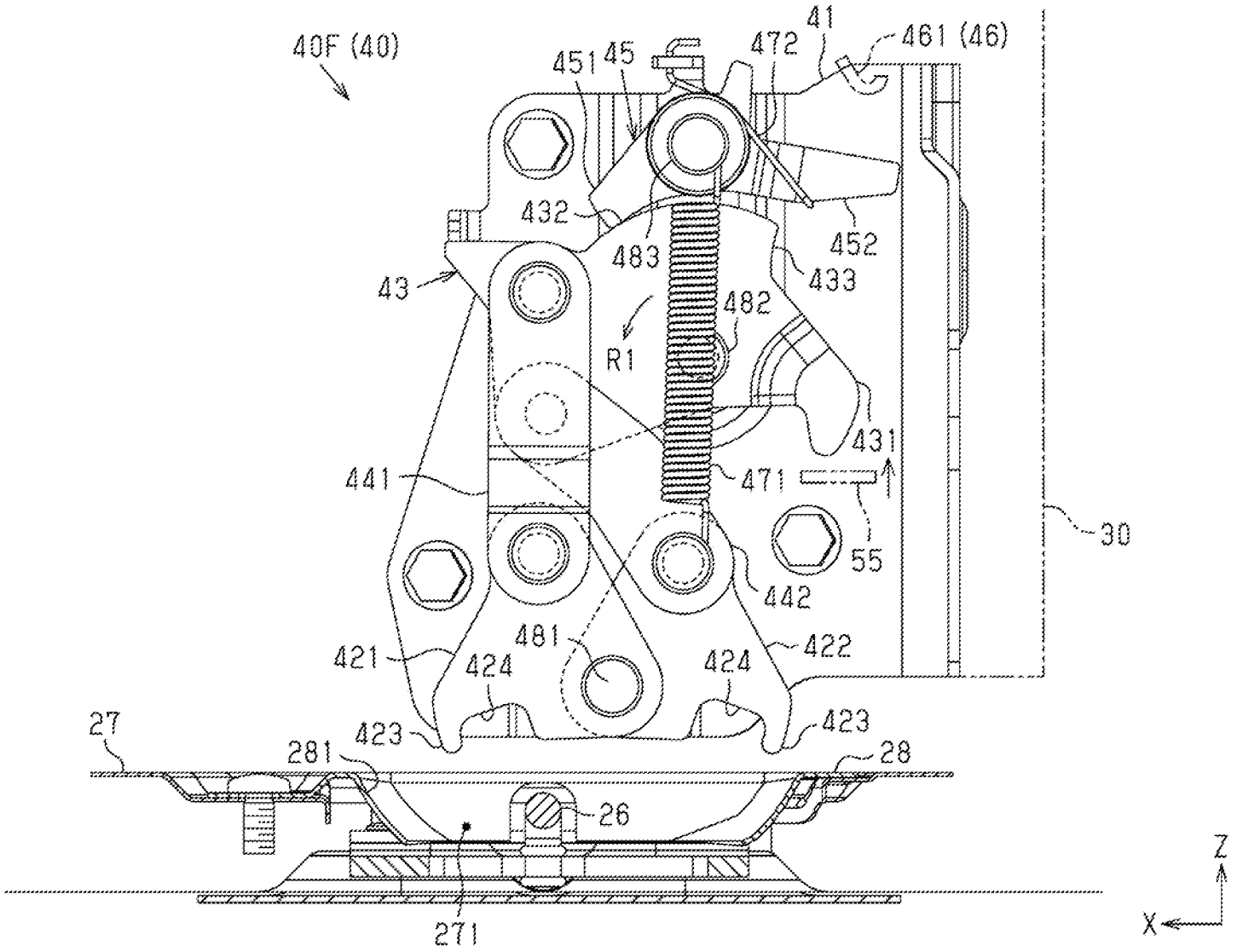
FIG. 8 is a front view of the lower lock device and the peripheral configuration when the first hook and the second hook are located in the retracted position in the first embodiment.

As illustrated in FIG. 10, when the first hook 421 and the second hook 422 rotate to the engaged position, the first hook 421 brings the lower striker 26 relatively into the width direction, and thus the first hook 421 brings the lower portion of the slide door 30 inward in the width direction. Thus, as illustrated in FIGS. 8 and 10, a position of the lower portion of the slide door 30 when the first hook 421 and the second hook 422 are disposed in the engaged position is located inward in the width direction further than a position of the lower portion of the slide door 30 when the first hook 421 and the second hook 422 are disposed in the retracted position. In other words, the first hook 421 and the second hook 422 rotate from the retracted position to the engaged position, and thus the lower portion of the slide door 30 moves inward in the width direction. Further, when the first hook 421 and the second hook 422 are disposed in the engaged position, only the first hook 421 is in a contact state with the lower striker 26 in order to fasten the slide door 30 that is to move outward in the width direction.

After the driving link 43 is disposed in the first position, the driving unit 56 of the lower lock driving device 50 is driven, and thus the active lever 53 rotates in a direction indicated by a solid line arrow in FIG. 9. In other words, the close lever 55 is lowered in a direction indicated by a solid line arrow in FIG. 10, and the close lever 55 is separated from the engagement protrusion 431 of the driving link 43. However, the pawl 45 makes it impossible for the driving link 43 to rotate toward the second position, and thus the driving link 43 remains in the first position even after the active lever 53 is separated from the engagement protrusion 431 of the driving link 43. In other words, the first hook 421 and the second hook 422 also remain in the engaged position.

Subsequently, when there is a request for the open operation of the slide door 30 from a user, the front lock driving device 36F and the rear lock driving device 36R are driven. As a result, the front lock device 34F and the rear lock device 34R shift to the release state, and the center lock device 35F and the lower lock device 40 shift to the release state.

Figure 11:
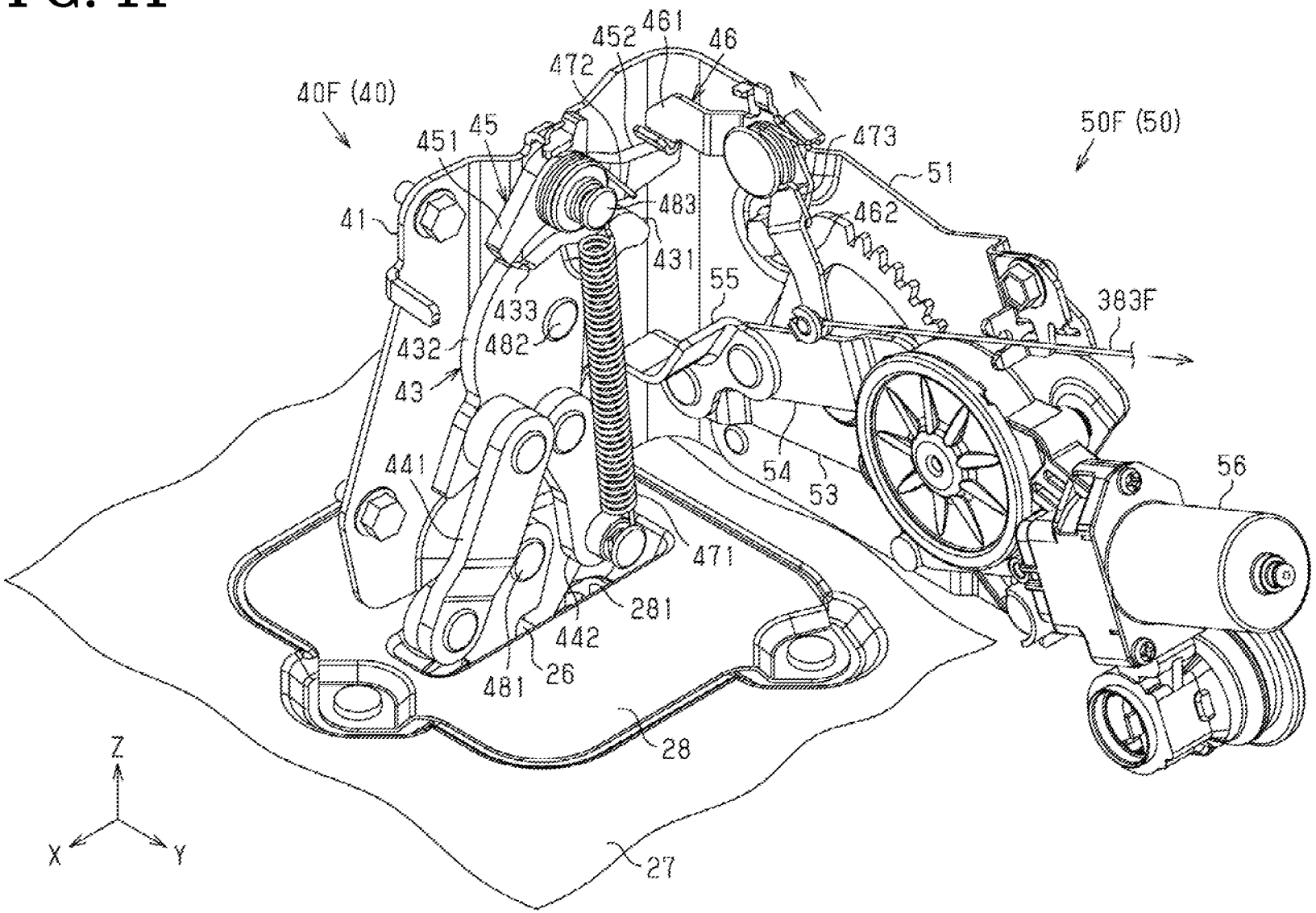
FIG. 11 is a perspective view of the lower lock device and the peripheral configuration when the first hook and the second hook return to the retracted position in the first embodiment.
Figure 12:
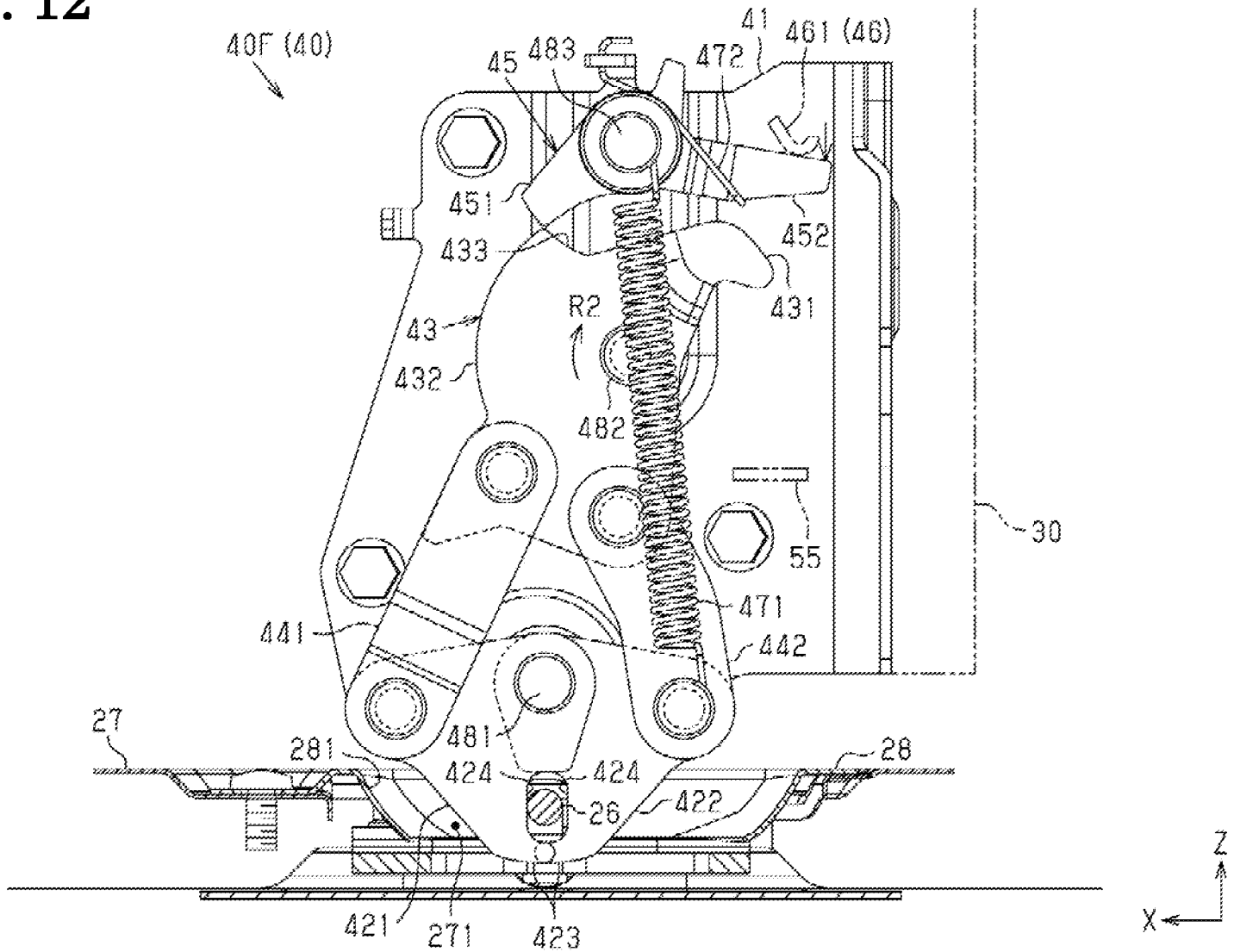
FIG. 12 is a front view of the lower lock device and the peripheral configuration when the first hook and the second hook return to the retracted position in the first embodiment.

As illustrated in FIG. 11, in the lower lock device 40, the remote control 37F pulls the third cable 383F in a direction indicated by a solid line arrow, and thus the release lever 46 rotates in a direction indicated by a solid line arrow. In other words, as illustrated in FIG. 12, the first lever 461 of the release lever 46 is lowered, and the first lever 461 of the release lever 46 pushes down the second engagement piece 452 of the pawl 45. Then, the first engagement piece 451 of the pawl 45 is separated from the driving link 43, and the first engagement piece 451 of the pawl 45 does not engage with the regulation surface 433 of the driving link 43.

The first hook 421 and the second hook 422 are biased by the hook biasing spring 422 in the direction in which the first hook 421 and the second hook 422 rotate from the engaged position toward the retracted position. Thus, after the pawl 45 does not engage with the driving link 43, the first hook 421 and the second hook 422 rotate toward the retracted position, and the driving link 43 rotates in a second rotational direction R2. When the first hook 421 and the second hook 422 return to the retracted position, the driving link 43 returns to the second position. In this way, the lower lock device 40 shifts to the state illustrated in FIGS. 7 and 8, i.e., the release state.

When the front lock device 34F, the rear lock device 34R, the center lock device 35F, and the lower lock device 40 shift to the release state, the slide door 30 is not restrained to the vehicle body 20. Thus, the door driving units 24F and 24R are driven, and the open operation of the slide door 30 starts.

Effects of the first embodiment will be described.

(1) The first hook 421 and the second hook 422 sandwich the lower striker 26, and thus the lower lock device 40 restrains the slide door 30 to the vehicle body 20. In other words, as long as the first hook 421 and the second hook 422 can sandwich the lower striker 26, the lower lock device 40 can restrain the slide door 30 to the vehicle body 20. In this respect, flexibility in arrangement of the first hook 421 and the second hook 422 with respect to the lower striker 26 is more likely to be increased. Therefore, the lower lock device 40 can restrain the slide door 30 in the full closed position regardless of an installation place of the lower striker 26.

(2) Power of the driving link 43 is transmitted to the first hook 421 and the second hook 422 by the link mechanism. Thus, the lower lock device 40 can achieve a power transmission mechanism for rotating the first hook 421 and the second hook 422 in different directions with a simple configuration.

(3) The lower lock device 40 includes the pawl 45 that restricts rotation of the driving link 43 to the second position by engaging with the driving link 43 disposed in the first position. Thus, the lower lock device 40 can fasten the first hook 421 and the second hook 422 in the engaged position even without the lower lock driving device 50 continuing to be driven. Further, the lower lock device 40 can simplify the configuration of the device in a point that the pawl 45 may be one.

(4) The lower lock device 40 includes the first support shaft 481 that rotatably supports both of the first hook 421 and the second hook 422. Thus, the lower lock device 40 can simplify the configuration of the device as compare to a case where a support shaft that rotatably supports the first hook 421 and a support shaft that rotatably supports the second hook 422 are different members.

(5) The lower striker 26 protruding from the floor 27 is suppressed by the covering plate 28 that covers the lower striker 26. Thus, when a user gets on and off the vehicle 10, the user is less likely to feel the lower striker 26 as a hindrance.

(6) When an impact acts on the slide door 30 inward in the width direction, the engagement between the second hook 422 and the lower striker 26 can suppress displacement of the slide door 30 inward in the width direction. For example, upon a side collision with the vehicle 10, the engagement between the second hook 422 and the lower striker 26 can suppress displacement of the slide door 30 toward the compartment, and can suppress entry of a colliding object with the vehicle 10 into the compartment.

Second Embodiment

A lower lock device 60 according to a second embodiment will be described below in detail. In the second embodiment, a configuration common to the first embodiment has the same reference sign, and description is omitted or simplified. Furthermore, since a shape and an arrangement of a constituent member are slightly different from those of the lower lock driving device 50 according to the first embodiment, a lower lock driving device 50 according to the second embodiment has the same reference sign and description is omitted. Further, In the second embodiment, the lower lock device 60 corresponds to one example of a "vehicular door lock device".

Figure 13:
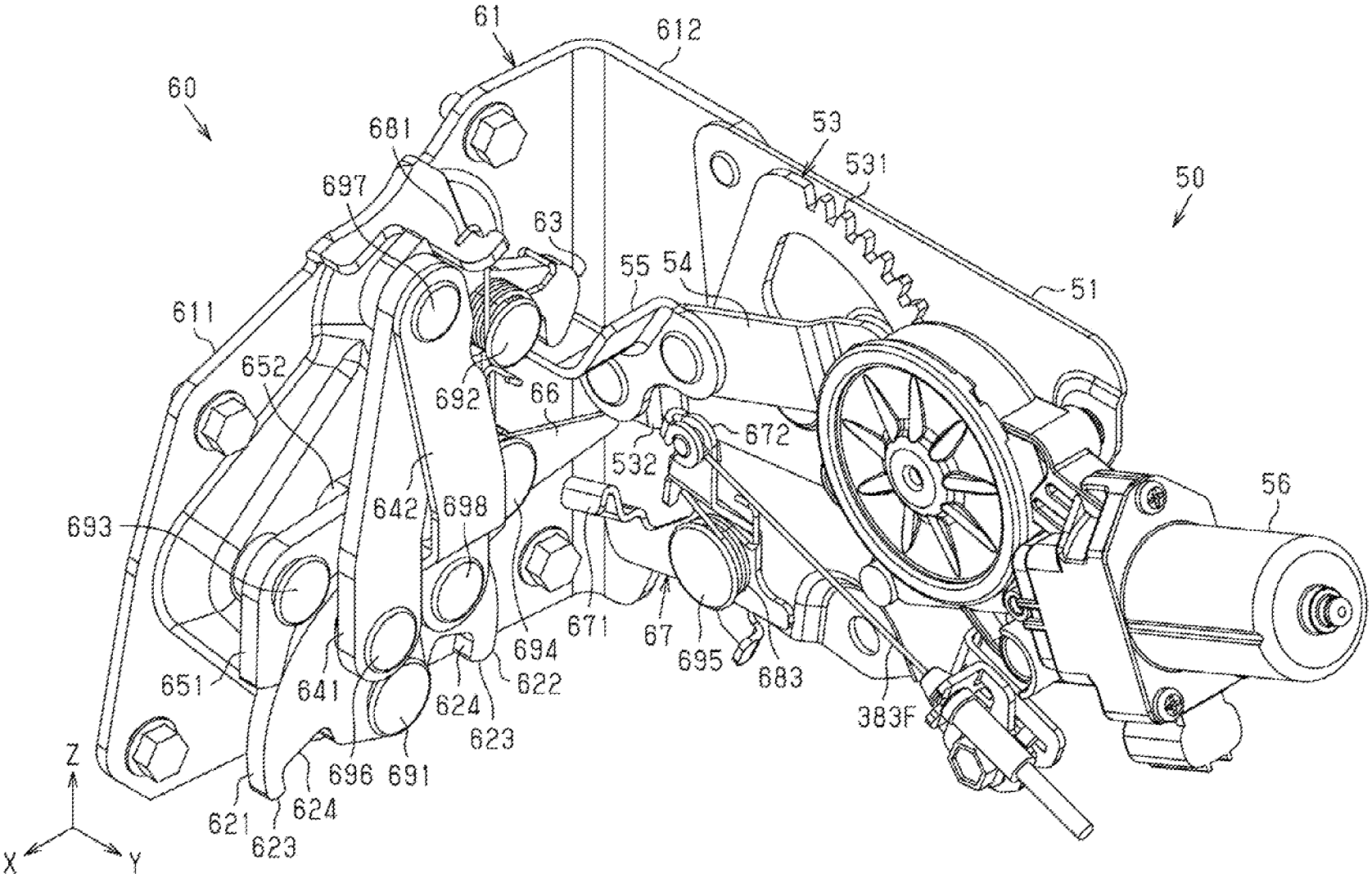
FIG. 13 is a perspective view of a lower lock device and a lower lock driving device according to a second embodiment.
Figure 14:
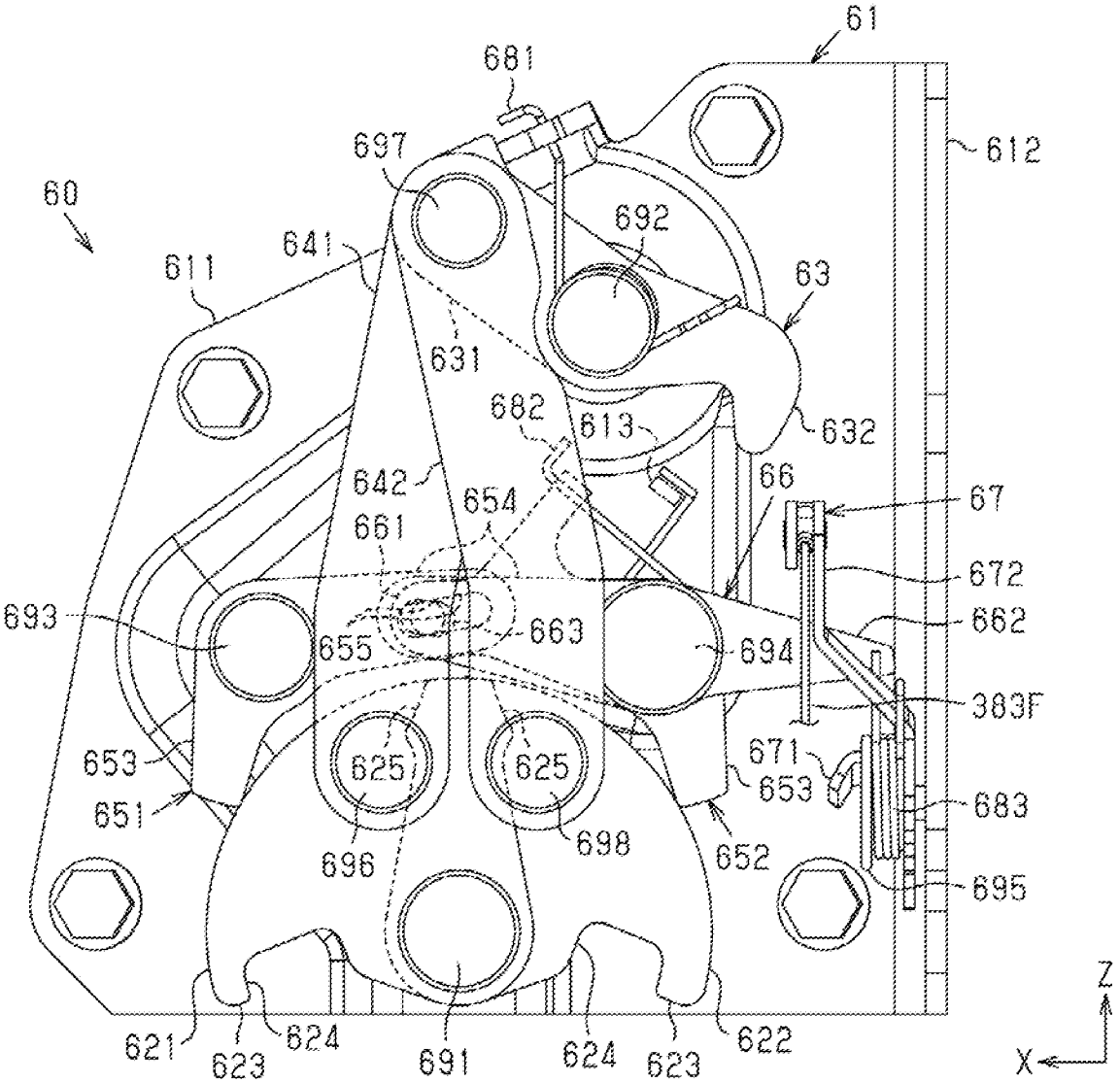
FIG. 14 is a front view of the lower lock device according to the second embodiment.
Figure 15:
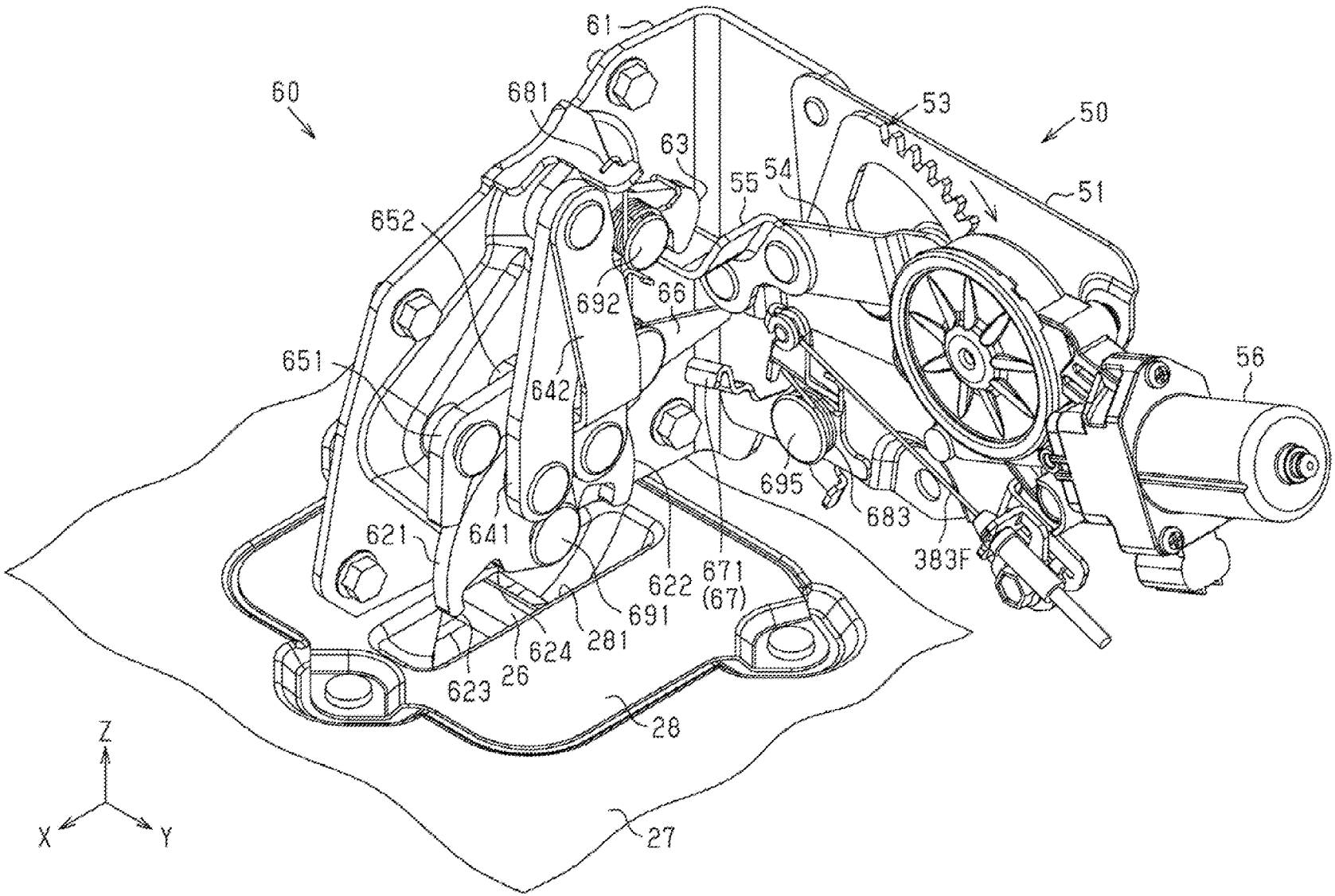
FIG. 15 is a perspective view of the lower lock device and a peripheral configuration when a first hook and a second hook are located in a retracted position in the second embodiment.

As illustrated in FIGS. 13 and 14, the lower lock device 60 includes a base 61 assembled to a slide door 30, a first hook 621 and a second hook 622 that engage with a lower striker 26, and a driving link 63 that drives the first hook 621 and the second hook 622. Further, the lower lock device 60 includes a first link 641 that couples the first hook 621 and the driving link 63, a second link 642 that couples the second hook 622 and the driving link 63, a first pawl 651 and a second pawl 652 that respectively engage with the first hook 621 and the second hook 622, a coupling lever 66 that operates together with the first pawl 651 and the second pawl 652, and a release lever 67 that drives the coupling lever 66.

Further, the lower lock device 60 includes a driving link biasing spring 681 that biases the driving link 63, a pawl biasing spring 682 that indirectly biases the first pawl 651 and the second pawl 652, and a release lever biasing spring 683 that biases the release lever 67. Further, the lower lock device 60 includes a first support shaft 691 as one example of a "support shaft" that rotatably supports both of the first hook 621 and the second hook 622, a second support shaft 692 that rotatably supports the driving link 63, third support shafts 693 and 694 that respectively rotatably support the first pawl 651 and the second pawl 652, and a fourth support shaft 695 that rotatably supports the release lever 67. Furthermore, the lower lock device 60 includes a first coupling shaft 696 that relatively rotatably couples the first hook 621 and the first link 641, a second coupling shaft 697 that relatively rotatably couples the driving link 63, the first link 641, and the second link 642, and a third coupling shaft 698 that relatively rotatably couples the second hook 622 and the second link 642.

As illustrated in FIGS. 13 and 14, the base 61 includes a first base 611 and a second base 612 having a flat plate shape. The first base 611 extends in a direction intersecting the second base 612 from the second base 612. Thus, the base 61 has a substantially L shape in a plan view from above. The first base 611 is fixed to the slide door 30 via a fastening member such as a bolt. The second base 612 is coupled to the lower lock driving device 50 via a fastening member such as a bolt.

As illustrated in FIG. 14, the first hook 621 and the second hook 622 are a plate-shaped member having a substantially fan shape in a front view. The first hook 621 and the second hook 622 are disposed on a lower end portion of the first base 611 by the first support shaft 691 having the front-rear direction as a shaft direction. In other words, a rotational shaft line of the first hook 621 and the second hook 622 extends in the front-rear direction.

In the first hook 621, when a portion supported by the first support shaft 691 and the first coupling shaft 696 is assumed to be a base end portion, the first hook 621 includes an engagement claw 623 and a recessed portion 624 on a tip portion. The engagement claw 623 extends in a rotational direction of the first hook 621, and the recessed portion 624 is recessed in an opposite direction to the direction in which the engagement claw 623 extends. Further, the first hook 621 includes, on an end surface opposite to an end surface provided with the engagement claw 623 in the rotational direction of the first hook 621, a regulation surface 625 intersecting a circumferential direction. Similarly, in the second hook 622, when a portion supported by the first support shaft 691 and the third coupling shaft 698 is assumed to be a base end portion, the second hook 622 includes an engagement claw 623 and a recessed portion 624 on a tip portion. Further, the second hook 622 includes, on an end surface opposite to an end surface provided with the engagement claw 623 in a rotational direction of the second hook 622, a regulation surface 625 intersecting the circumferential direction.

The first hook 621 and the second hook 622 rotate about a shaft line of the first support shaft 691 between an engaged position of sandwiching the lower striker 26 by bringing the tip portions closer to each other and a retracted position in which the tip portions are separated from each other. In the present embodiment, when the first hook 621 and the second hook 622 rotate between the engaged position and the retracted position, the first hook 621 and the second hook 622 have a positional relationship having substantial line symmetry with respect to a straight line passing through the center of the first support shaft 691 and extending in the up-down direction in FIG. 14. Further, when the first hook 621 and the second hook 622 are located in the engaged position, the lower striker 26 fits into the recessed portion 624 of the first hook 621 and the second hook 622.

As illustrated in FIGS. 13 and 14, the driving link 63 is disposed on an upper portion of the first base 611 by the second support shaft 692 having the front-rear direction as a shaft direction. As illustrated in FIG. 14, the driving link 63 includes a first portion 631 and a second portion 632 extending in a direction that intersects the shaft direction of the second support shaft 692. A tip of the first portion 631 is rotatably coupled to the first link 641 and the second link 642 via the second coupling shaft 697. The second portion 632 extends toward the second base 612. The driving link 63 corresponds to one example of a "driving body".

As illustrated in FIG. 14, the first link 641 constitutes a four-joint link mechanism together with the driving link 63, the first base 611, and the first hook 621. In the four-joint link mechanism including the first link 641, a distance between shaft lines of the first support shaft 691 and the second support shaft 692 is longer than a distance between shaft lines of the first coupling shaft 696 and the second coupling shaft 697. Further, a distance between shaft lines of the first support shaft 691 and the first coupling shaft 696 and a distance between shaft lines of the second support shaft 692 and the second coupling shaft 697 are shorter than the distance between the shaft lines of the first coupling shaft 696 and the second coupling shaft 697. The first link 641 corresponds to a so-called intermediate link, and transmits power of the driving link 63 to the first hook 621.

On the other hand, the second link 642 constitutes a four-joint link mechanism together with the driving link 63, the first base 611, and the second hook 622. In the four-joint link mechanism including the second link 642, the distance between the shaft lines of the first support shaft 691 and the second support shaft 692 is longer than a distance between shaft lines of the second coupling shaft 697 and the third coupling shaft 698. Further, a distance between shaft lines of the first support shaft 691 and the third coupling shaft 698 and a distance between shaft lines of the second support shaft 692 and the second coupling shaft 697 are shorter than the distance between the shaft lines of the second coupling shaft 697 and the third coupling shaft 698. The second link 642 corresponds to a so-called intermediate link, and transmits power of the driving link 63 to the second hook 622.

The four-joint link mechanism including the first link 641 and the four-joint link mechanism including the second link 642 share the driving link 63. Thus, when the driving link 63 rotates, the first hook 621 and the second hook 622 rotate together. Further, when one of the first hook 621 and the second hook 622 rotates, the other of the first hook 621 and the second hook 622 rotates with the driving link 63. In other words, the first hook 621, the second hook 622, the driving link 63, the first link 641, and the second link 642 operate with each other. Therefore, when a position of the driving link 63 is determined, positions of the first hook 621 and the second hook 622 are also uniquely defined.

In the following description, it is assumed that a position of the driving link 63 when the first hook 621 and the second hook 622 are disposed in the engaged position is a "first position", and a position of the driving link 63 when the first hook 621 and the second hook 622 are disposed in the retracted position is a "second position". Further, the driving link 63 is displaced between the first position and the second position by rotating about the shaft line of the second support shaft 692.

As illustrated in FIGS. 13 and 14, the first pawl 651 and the second pawl 652 are each disposed on an intermediate portion of the first base 611 by the third support shafts 693 and 694 having the front-rear direction as a shaft direction.

As illustrated in FIG. 14, the first pawl 651 includes a first engagement piece 653 and a second engagement piece 654 extending in a direction that intersects the shaft direction of the third support shaft 693. In the first pawl 651, the first engagement piece 653 extends toward the first hook 621, and the second engagement piece 654 extends toward the second base 612. The second engagement piece 654 of the first pawl 651 includes a guide hole 655 that penetrates a tip.

Similarly, the second pawl 652 includes a first engagement piece 653 and a second engagement piece 654 extending in a direction that intersects the shaft direction of the third support shaft 694. In the second pawl 652, the first engagement piece 653 extends toward the second hook 622, and the second engagement piece 654 extends in a direction away from the second base 612. The second engagement piece 654 of the second pawl 652 includes a guide hole 655 that penetrates a tip.

As illustrated in FIG. 14, the coupling lever 66 is disposed on the intermediate portion of the first base 611 in the up-down direction by the third support shaft 694. In other words, a rotational shaft line of the coupling lever 66 coincides with a rotational shaft line of the second pawl 652. The coupling lever 66 includes a first lever 661 and a second lever 662 extending in a direction that intersects the shaft direction of the third support shaft 694. The first lever 661 extends in a direction farther from the second base 612, and the second lever 662 extends toward the second base 612.

The first lever 661 includes, on the tip, a guide shaft 663 extending in a shaft direction of the third support shaft 694. The guide shaft 663 is inserted through the guide hole 655 of the first pawl 651 and the second pawl 652. Thus, when the coupling lever 66 rotates, the first pawl 651 and the second pawl 652 rotate. Specifically, when the coupling lever 66 rotates in a direction in which the second lever 662 rises, the first pawl 651 rotates in a direction in which the first engagement piece 653 moves farther from the first hook 621, and the second pawl 652 rotates in a direction in which the first engagement piece 653 moves farther from the second hook 622.

As illustrated in FIG. 13, the release lever 67 is disposed on a lower portion of the second base 612 by the fourth support shaft 695 having the width direction as a shaft direction. The release lever 67 includes a first lever 671 and a second lever 672 extending in a direction that intersects the shaft direction of the fourth support shaft 695. The first lever 671 extends toward the first base 611, and the second lever 672 extends along the first base 611. A rear end of a third cable 383F extending from a remote control 37F is fixed to a tip of the second lever 672. When the third cable 383F is pulled, the release lever 67 rotates in a direction in which a tip of the first lever 671 rises.

As illustrated in FIG. 14, the driving link biasing spring 681 is a so-called torsion coil spring. The driving link biasing spring 681 has one end engaged with the first base 611, and has another end engaged with the second portion 632 of the driving link 63. The driving link biasing spring 681 biases the driving link 63 in a direction in which the driving link 63 rotates from the first position toward the second position. As described above, in the lower lock device 60, when the driving link 63 rotates, the first hook 621 and the second hook 622 rotate, and thus it can also be said that the driving link biasing spring 681 biases both of the first hook 621 and the second hook 622. In this respect, the driving link biasing spring 681 can replace the configuration in which the first hook 621 is biased, and can also replace the configuration in which the second hook 622 is biased.

As illustrated in FIG. 14, the pawl biasing spring 682 is a so-called torsion coil spring. The pawl biasing spring 682 has one end engaged with the engagement piece 613 integral with the first base 611, and has another end engaged with the first lever 661 of the coupling lever 66. The pawl biasing spring 682 biases the coupling lever 66 in a direction in which the second lever 662 of the coupling lever 66 is lowered. In other words, the pawl biasing spring 682 biases the first pawl 651 in a direction in which the first engagement piece 653 of the first pawl 651 pushes the first hook 621, and biases the second pawl 652 in a direction in which the first engagement piece 653 of the second pawl 652 pushes the second hook 622, via the coupling lever 66.

As illustrated in FIG. 13, the release lever biasing spring 683 is a so-called torsion coil spring. The release lever biasing spring 683 has one end engaged with a support plate 51 of the lower lock driving device 50, which will be described later, and has another end engaged with the second lever 672 of the release lever 67, while the fourth support shaft 695 is inserted. As illustrated in FIG. 14, the release lever biasing spring 683 biases the release lever 67 in a direction in which the tip of the first lever 671 moves away from the second lever 662 of the coupling lever 66.

In the present embodiment, one example of a "vehicular door lock system" including the lower lock device 60, the lower lock driving device 50, the lower striker 26, and a covering plate 28 described above is constituted.

Action of the present embodiment will be described.

Specifically, with reference to FIGS. 15 to 20, action of the lower lock device 60 during a close operation and an open operation of the slide door 30 will be described.

In a vehicle 10, when there is a request for the close operation of the slide door 30 from a user, door driving units 24F and 24R are driven, and the close operation of the slide door 30 starts. When the slide door 30 performs the close operation to the vicinity of a full closed position, a front lock driving device 36F and a rear lock driving device 36R are driven instead of the door driving units 24F and 24R. As a result, a front lock device 34F and a rear lock device 34R shift to an engagement state, and the slide door 30 is disposed in the full closed position in which the slide door 30 fully closes a door opening 21.

When the slide door 30 is disposed in the full closed position, a rear end portion of a first slide door 30F and a front end portion of a second slide door 30R are located the closest to each other. Thus, a latch 351 of a center lock device 35F of the first slide door 30F engages with a center striker 35R of the second slide door 30R. In other words, when the slide door 30 is disposed in a full open position, the center lock device 35F also shifts to the engagement state.

After the slide door 30 is disposed in the full closed position, the lower lock driving device 50 is driven. Specifically, a driving unit 56 is driven, and thus an active lever 53 rotates in a direction indicated by a solid line arrow in FIG. 15. Then, a close lever 55 rises in a direction indicated by a solid line arrow in FIG. 16, and the close lever 55 pushes the second portion 632 of the driving link 63 upward. As a result, the driving link 63 rotates in a first rotational direction R1 from the second position, and power is transmitted to the first hook 621 and the second hook 622 via the first link 641 and the second link 642.

Figure 17:
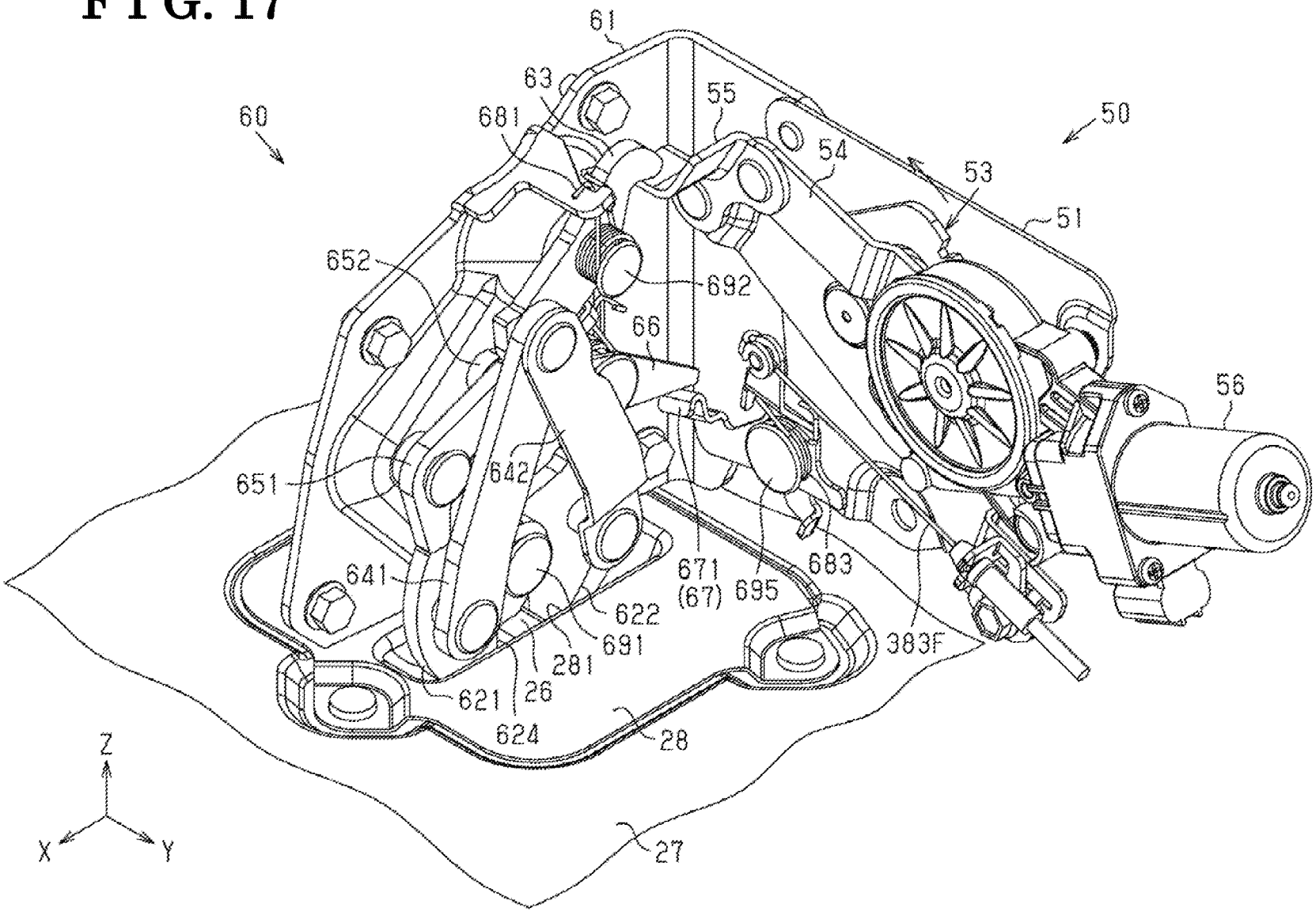
FIG. 17 is a perspective view of the lower lock device and the peripheral configuration when the first hook and the second hook are located in an engaged position in the second embodiment.
Figure 18:
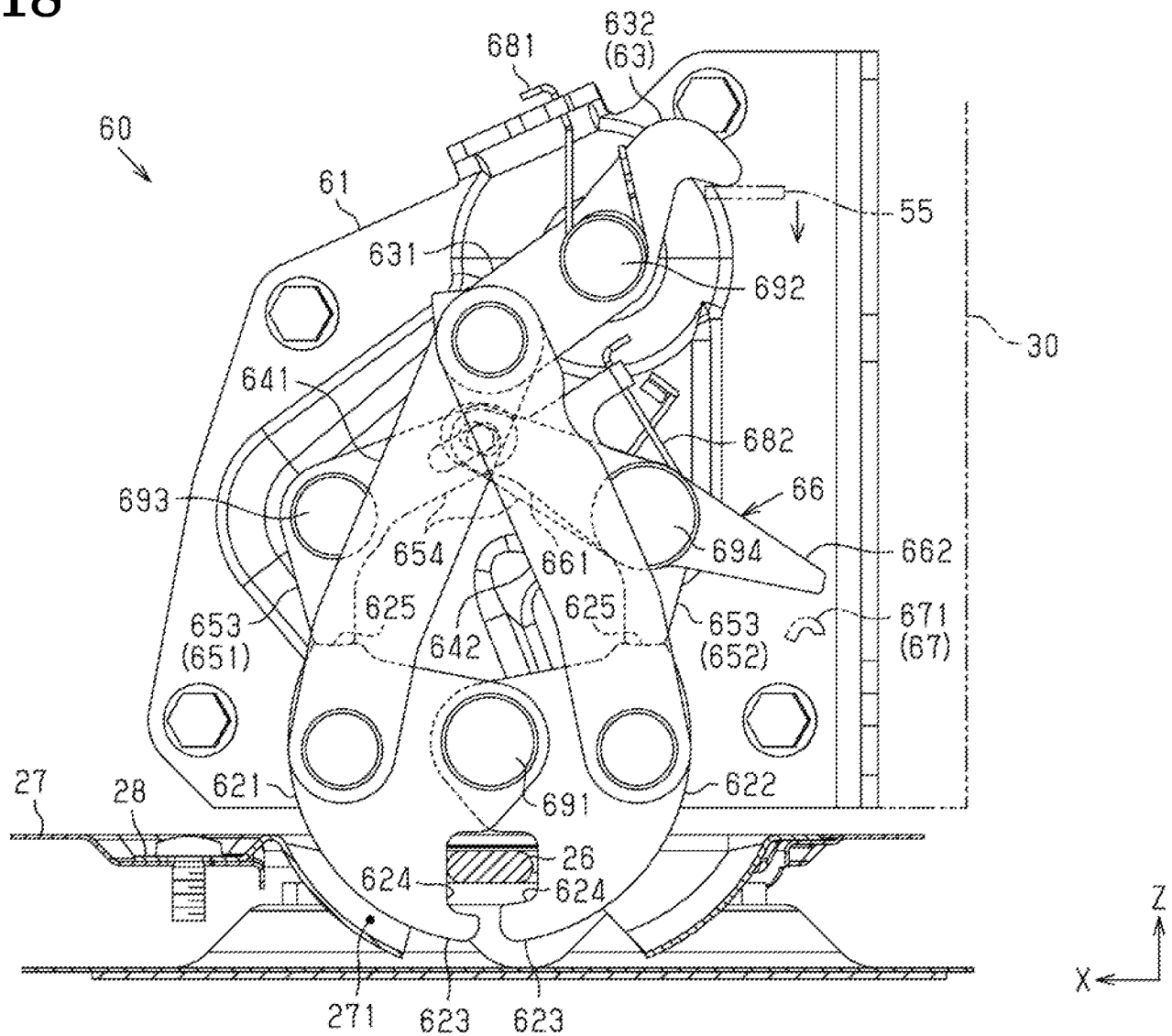
FIG. 18 is a front view of the lower lock device and the peripheral configuration when the first hook and the second hook are located in the engaged position in the second embodiment.

As illustrated in FIGS. 17 and 18, when the close lever 55 rises the highest, the driving link 63 is disposed in the first position. When the driving link 63 is disposed in the first position, the first hook 621 and the second hook 622 are located in the engaged position of sandwiching the lower striker 26. In this way, a movement of the lower portion of the slide door 30 in the width direction is restricted, and an attitude of the slide door 30 in the full closed position is stable. Further, when the driving link 63 rotates in the first rotational direction R1, the driving link biasing spring 681 is extended.

As illustrated in FIG. 18, when the driving link 63 is disposed in the first position, the first engagement piece 653 of the first pawl 651 engages with the regulation surface 625 of the first hook 621, and the first engagement piece 653 of the second pawl 652 engages with the regulation surface 625 of the second hook 622. In other words, it is impossible for the first hook 621 and the second hook 622 to rotate toward the retracted position, and it is impossible for the driving link 63 to rotate toward the second position.

Figure 16:
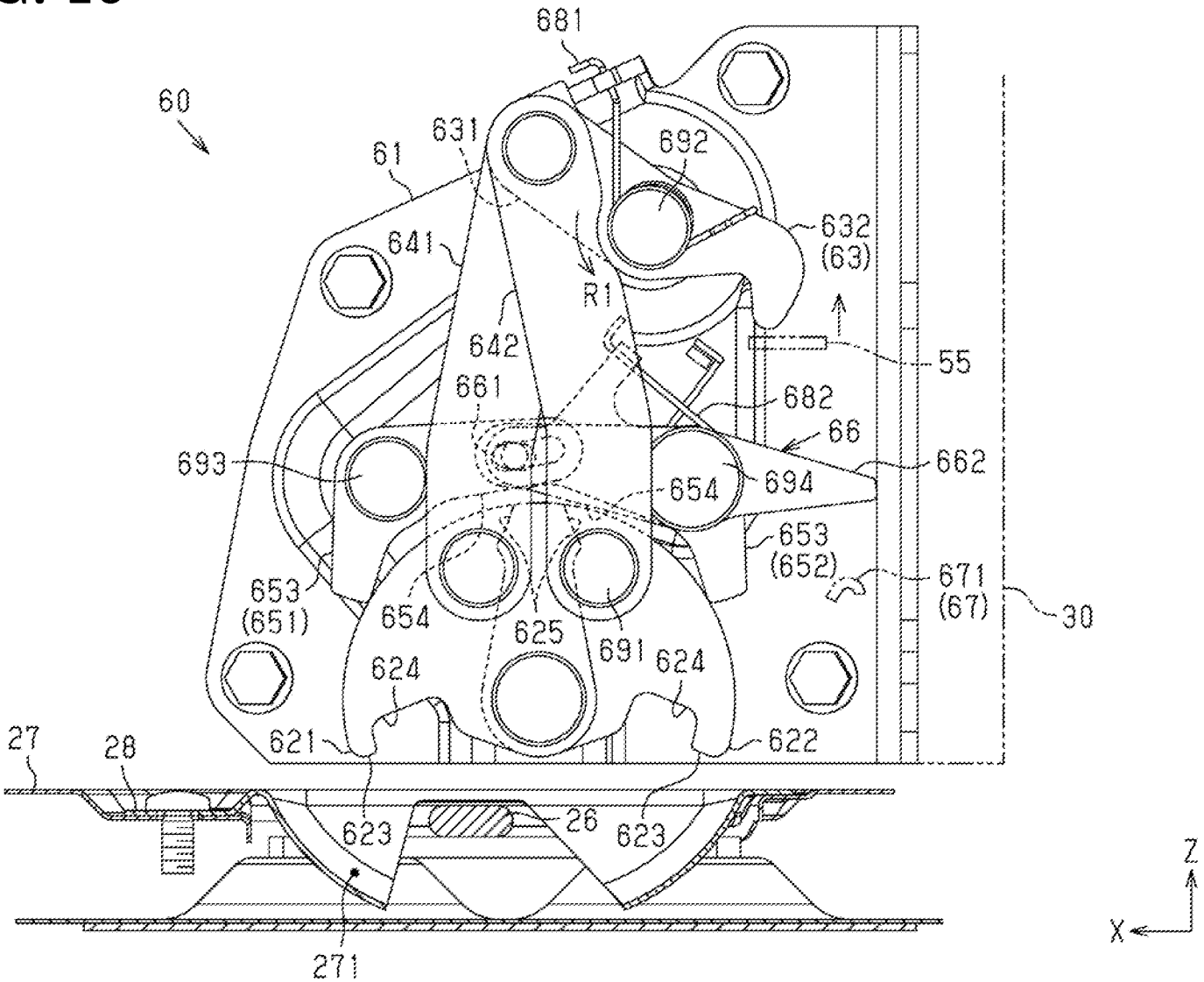
FIG. 16 is a front view of the lower lock device and the peripheral configuration when the first hook and the second hook are located in the retracted position in the second embodiment.

Furthermore, when the first hook 621 and the second hook 622 are disposed in the engaged position, the first hook 621 brings the lower striker 26 relatively into the width direction, and thus the first hook 621 brings the lower portion of the slide door 30 inward in the width direction. Thus, as illustrated in FIGS. 16 and 18, a position of the lower portion of the slide door 30 when the first hook 621 and the second hook 622 are disposed in the engaged position is located inward in the width direction further than a position of the lower portion of the slide door 30 when the first hook 621 and the second hook 622 are disposed in the retracted position.

After the driving link 63 is disposed in the first position, the driving unit 56 of the lower lock driving device 50 is driven, and thus the active lever 53 rotates in a direction indicated by a solid line arrow in FIG. 17. In other words, the close lever 55 is lowered in a direction indicated by a solid line arrow in FIG. 18, and the close lever 55 is separated from the second portion 632 of the driving link 63. Herein, the first hook 621 and the second hook 622 are in a state where the first pawl 651 and the second pawl 652 make it impossible for the first hook 621 and the second hook 622 to rotate toward the retracted position. Thus, even after the driving link 63 is separated from the active lever 53, the first hook 621 and the second hook 622 remain in the engaged position. In other words, the driving link 63 also remains in the first position.

Subsequently, when there is a request for the open operation of the slide door 30 from a user, the front lock driving device 36F and the rear lock driving device 36R are driven. As a result, the front lock device 34F and the rear lock device 34R shift to the release state, and the center lock device 35F and the lower lock device 60 shift to the release state.

Figure 19:
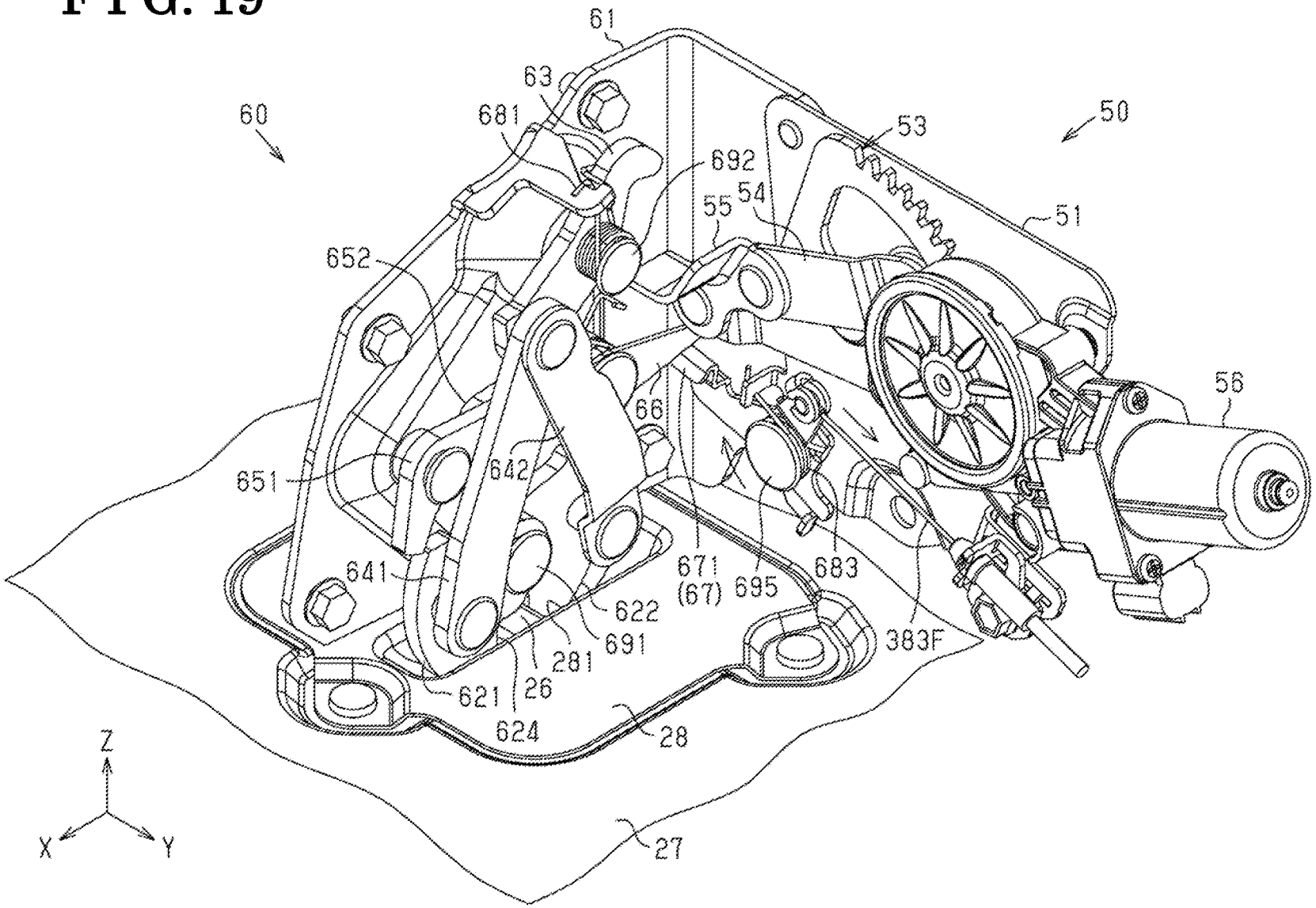
FIG. 19 is a perspective view of the lower lock device and the peripheral configuration when the first hook and the second hook return to the retracted position in the second embodiment.
Figure 20:
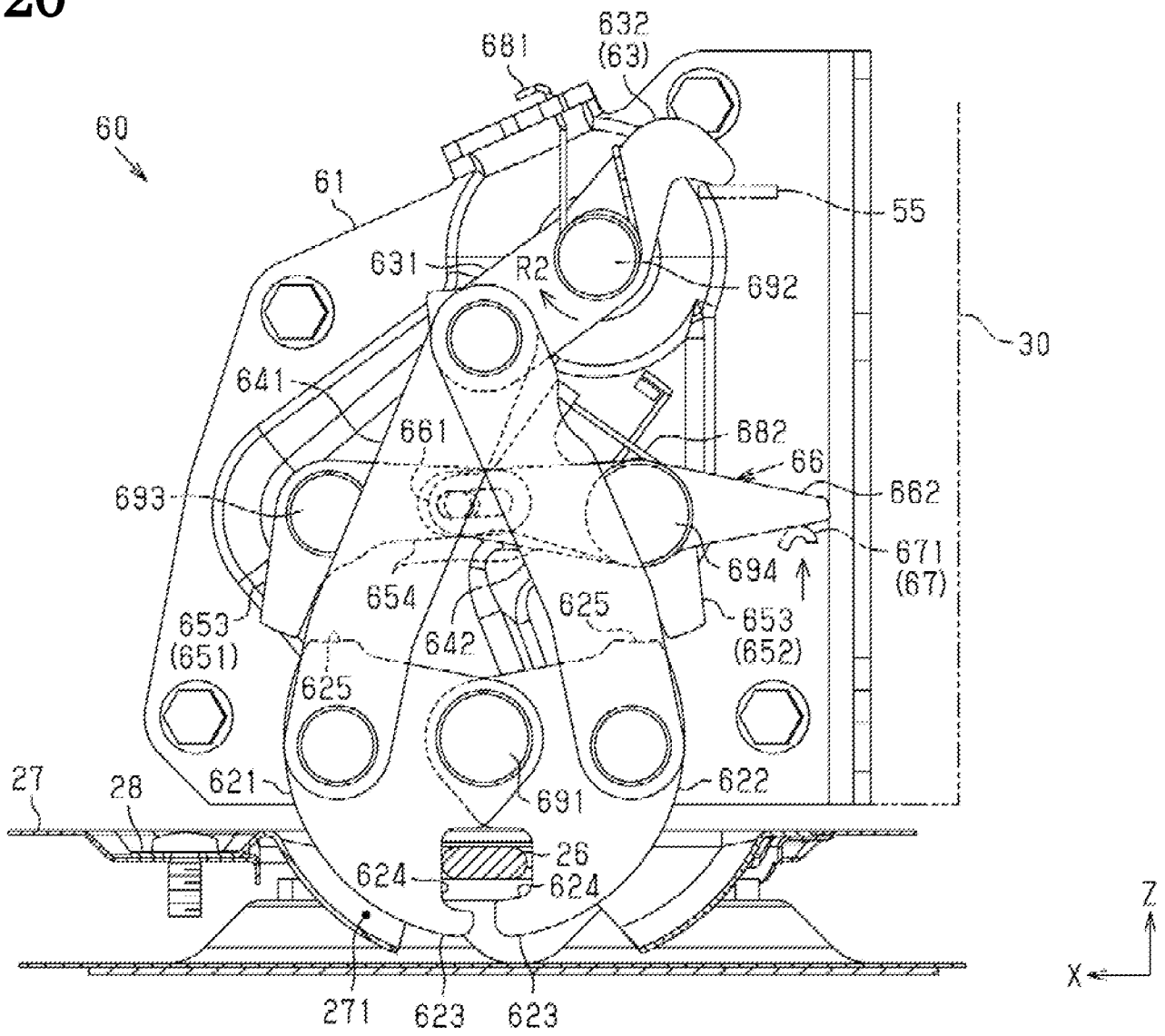
FIG. 20 is a front view of the lower lock device and the peripheral configuration when the first hook and the second hook return to the retracted position in the second embodiment.

As illustrated in FIG. 19, in the lower lock device 60, the remote control 37F pulls the third cable 383F in a direction indicated by a solid line arrow, and thus the release lever 67 rotates in a direction indicated by a solid line arrow. In other words, as illustrated in FIG. 20, the tip of the first lever 671 of the release lever 67 rises, and the first lever 671 of the release lever 67 pushes up the second lever 662 of the coupling lever 66. Then, the first lever 661 of the coupling lever 66 pushes down the second engagement piece 654 of the first pawl 651 and the second engagement piece 654 of the second pawl 652. As a result, the first pawl 651 rotates in a direction in which the first engagement piece 653 of the first pawl 651 is separated from the first hook 621, and the second pawl 652 rotates in a direction in which the first engagement piece 653 of the second pawl 652 is separated from the second hook 622. As a result, the first engagement piece 653 of the first pawl 651 does not engage with the regulation surface 625 of the first hook 621, and the first engagement piece 653 of the second pawl 652 does not engage with the regulation surface 625 of the second hook 622.

As described above, the driving link 63 is biased by the driving link biasing spring 681 from the second position toward the first position. Thus, after the first pawl 651 and the second pawl 652 do not engage with the first hook 621 and the second hook 622, respectively, the driving link 63 rotates in a second rotational direction R2, and the first hook 621 and the second hook 622 rotate toward the retracted position. When the driving link 63 returns to the second position, the first hook 621 and the second hook 622 return to the retracted position. In this way, the lower lock device 60 shifts to the state illustrated in FIGS. 16 and 17, i.e., the release state.

An effect of the second embodiment will be described. The second embodiment can acquire the following effect in addition to the effects (1), (2), (4), (5), and (6) of the first embodiment.

(7) The lower lock device 60 includes the first pawl 651 and the second pawl 652 that restrict rotation of the first hook 621 and the second hook 622 to the retracted position, respectively. Thus, the lower lock device 60 can fasten the first hook 621 and the second hook 622 in the engaged position even without the lower lock driving device 50 continuing to be driven. Further, the lower lock device 60 can more firmly fasten the first hook 621 and the second hook 622 in the engaged position in a point that the lower lock device 60 includes the first pawl 651 and the second pawl 652 that engage with the first hook 621 and the second hook 622 disposed in the engaged position, respectively.

The present embodiment can be performed by making a modification as follows. The present embodiment and the following modification example can be combined as long as they are not technically inconsistent.

Installation places of the lower striker 26 and the lower lock device 40 may be replaced. In other words, the lower lock device 40 may be disposed on the lower end portion of the door opening 21 of the vehicle body 20, and the lower striker 26 may be installed on the lower end portion of the slide door 30.

The driving link 43 may be constituted as a "driving body" that linearly advances and retreats in a specific direction. In this case, the lower lock device 40 may include, instead of the first link 441 and the second link

442, a conversion mechanism for converting a linear motion of the driving body into a rotational motion of the first hook 421 and the second hook 422.

The driving link 43 itself may be constituted as an actuator. For example, the driving link 43 may be constituted by a solenoid and the like.

A mechanism for transmitting power from the driving link 43 to the first hook 421 and the second hook 422 can be appropriately changed. For example, the power transmission mechanism may be a mechanism constituted by a plurality of gears, and may be a mechanism including a wire.

The lower lock device 40 may separately include a support shaft that supports the first hook 421 and a support shaft that supports the second hook 422. Further, the lower lock device 40 may separately include a first driving link that drives the first hook 421 and a second driving link that drives the second hook 422.

The lower lock device 40 may be provided on the upper portion of the slide door 30. In this case, the lower striker 26 is an upper striker installed on the upper end portion of the door opening 21.

The vehicle body 20 may include a lower rail disposed below the door opening 21, and the slide door 30 may include a lower guide unit that moves in the front-rear direction along the lower rail. Also, in this case, the lower lock device 40 is in the engagement state, and thus an attitude of the lower end portion of the slide door 30 in the full closed position can be stable.

The slide door 30 may be provided on the front portion of the vehicle 10, and may be provided on the rear portion of the vehicle 10. In other words, a movement direction when the slide door 30 performs the open/close operations may be the width direction.

The slide door 30 may be a back door that opens and closes a door opening provided in the rear portion of the vehicle body 20. Further, the slide door 30 may be a door that swings around a shaft line extending in the up-down direction or the front-rear direction.

A vehicular door lock device that solves the problem described above is a vehicular door lock device that is provided on one of a door and a vehicle body, and restrains the door to the vehicle body by engaging with a striker provided on another of the door and the vehicle body. The vehicular door lock device includes a base being fixed to one of the door and the vehicle body, a first hook and a second hook each including a base end portion being rotatably supported by the base, and a driving body that is rotatably supported by the base and drives the first hook and the second hook. The first hook and the second hook rotate between an engaged position of sandwiching the striker by tip portions being close to each other and a retracted position in which the tip portions are separated from each other. The driving body is displaced between a first position in which the first hook and the second hook are disposed in the engaged position and a second position in which the first hook and the second hook are disposed in the retracted position.

A conventional vehicular door lock device includes a latch including a groove that meshes with a striker. Then, the striker enters the groove of the latch due to a close operation of a door, and the latch meshes with the striker, and thus the door is restrained to a vehicle body. In this respect, in the vehicular door lock device having the configuration described above, the first hook and the second hook sandwich the striker, and thus the door is restrained to the vehicle body. In other words, in the vehicular door lock device having the configuration described above, as long as the first hook and the second hook can sandwich the striker, the door can be restrained to the vehicle body. Thus, flexibility in arrangement of the first hook and the second hook with respect to the striker is more likely to be increased. Therefore, the vehicular door lock device can restrain the door in a full closed position regardless of an installation place of the striker.

The vehicular door lock device described above may further include a first link that transmits power of the driving body to the first hook and constitutes a link mechanism together with the driving body and the first hook, and a second link that transmits power of the driving body to the second hook and constitutes a link mechanism together with the driving body and the second hook.

In the vehicular door lock device having the configuration described above, power of the driving body is transmitted to the first hook and the second hook by the link mechanism. In other words, the vehicular door lock device can achieve a power transmission mechanism for rotating the first hook and the second hook between the engaged position and the retracted position, with a simple configuration.

In the vehicular door lock device described above, the driving body may be biased in a direction from the first position toward the second position, and the vehicular door lock device may further include a pawl that restricts displacement of the driving body to the second position by engaging with the driving body disposed in the first position.

The vehicular door lock device having the configuration described above can fasten the first hook and the second hook in the engaged position even without the driving body continuing to drive the first hook and the second hook. Further, the vehicular door lock device can simplify the configuration of the device in a point that the pawl may be one.

In the vehicular door lock device described above, the first hook and the second hook may be biased in a direction from the engaged position toward the retracted position, and the vehicular door lock device may further include a first pawl and a second pawl that respectively restrict rotation of the first hook and the second hook to the retracted position by engaging with the first hook and the second hook disposed in the engaged position, respectively.

The vehicular door lock device having the configuration described above can fasten the first hook and the second hook in the engaged position even without the driving body continuing to drive the first hook and the second hook. Further, the vehicular door lock device can more firmly fasten the first hook and the second hook in the engaged position in a point that the vehicular door lock device includes the first pawl and the second pawl that engage with the first hook and the second hook disposed in the engaged position, respectively.

The vehicular door lock device described above may further include a support shaft that rotatably supports both of the first hook and the second hook.

The vehicular door lock device having the configuration described above can simplify the configuration of the device as compare to a case where a support shaft that rotatably supports the first hook and a support shaft that rotatably supports the second hook are different members.

A vehicular door lock system that solves the problem described above includes the vehicular door lock device described above, and the striker. The striker is provided on a lower end of a door opening to be opened and closed by the door in a state where a portion sandwiched between the first hook and the second hook extends in a vehicle front-rear direction. The vehicular door lock device is provided on the door in a state where a rotational shaft line of the first hook and a rotational shaft line of the second hook extend in the vehicle front-rear direction.

The vehicular door lock system having the configuration described above can acquire a similar operational advantageous effect to that of the vehicular door lock device described above. Further, in the vehicular door lock system, when an impact acts on the door inward in a vehicle width direction, the engagement between the hook located outward in the vehicle width direction among the first hook and the second hook and the striker can suppress displacement of the door inward in the vehicle width direction. In other words, in the vehicular door lock system, upon a side collision with the vehicle, the engagement between the hook located outward in the vehicle width direction and the striker can suppress displacement of the door toward the compartment.

The vehicular door lock system described above may further include a covering plate that covers the striker, and the covering plate may include a slit that exposes the striker.

The vehicular door lock system having the configuration described above can suppress the striker protruding from the lower end of the door opening. Thus, the vehicular door lock system can suppress a user who gets on and off the vehicle feeling the striker as a hindrance.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A vehicular door lock device that is provided on one of a door and a vehicle body, and restrains the door to the vehicle body by engaging with a striker provided on another of the door and the vehicle body, the vehicular door lock device comprising:

a base being fixed to one of the door and the vehicle body;

a first hook and a second hook each including a base end portion being rotatably supported by the base; and a driving body that is rotatably supported by the base, and drives the first hook and the second hook, wherein the first hook and the second hook rotate between an engaged position of sandwiching the striker by tip portions being close to each other and a retracted position in which the tip portions are separated from each other, the driving body is displaced between a first position in which the first hook and the second hook are disposed in the engaged position and a second position in which the first hook and the second hook are disposed in the retracted position, the driving body is biased in a direction from the first position toward the second position, and the vehicular door lock device further comprises a pawl that restricts displacement of the driving body to the second position by engaging with the driving body disposed in the first position.

2. The vehicular door lock device according to claim 1, further comprising:

a first link that transmits power of the driving body to the first hook, and constitutes a first link mechanism together with the driving body and the first hook; and a second link that transmits power of the driving body to the second hook, and constitutes a second link mechanism together with the driving body and the second hook.

3. The vehicular door lock device according to claim 1, wherein the first hook and the second hook are biased in a direction from the engaged position toward the retracted position, the pawl is a first pawl, and the vehicular door lock device further comprises a second pawl that, along with the first pawl, respectively restrict rotation of the first hook and the second hook to the retracted position by engaging with the first hook and the second hook disposed in the engaged position, respectively.

4. The vehicular door lock device according to claim 1, further comprising a support shaft that rotatably supports both of the first hook and the second hook.

5. A vehicular door lock system, comprising:

the vehicular door lock device according to claim 1; and the striker, wherein the striker is provided on a lower end of a door opening to be opened and closed by the door in a state where a portion sandwiched between the first hook and the second hook extends in a vehicle front-rear direction, and the vehicular door lock device is provided on the door in a state where a rotational shaft line of the first hook and a rotational shaft line of the second hook extend in the vehicle front-rear direction.

6. The vehicular door lock system according to claim 5, further comprising a covering plate that covers the striker, wherein the covering plate includes a slit that exposes the striker.

* * * * *